US009066392B2

(12) United States Patent
Lee

(10) Patent No.: US 9,066,392 B2
(45) Date of Patent: Jun. 23, 2015

(54) LED DRIVING DEVICE AND LED DRIVING METHOD USING SAME

(76) Inventor: Dong-Il Lee, Gyeonggi-do (KR)

( * ) Notice: Subject to any disclaimer, the term of this patent is extended or adjusted under 35 U.S.C. 154(b) by 0 days.

(21) Appl. No.: 14/112,601

(22) PCT Filed: Apr. 18, 2012

(86) PCT No.: PCT/KR2012/002964

§ 371 (c)(1),
(2), (4) Date: Oct. 18, 2013

(87) PCT Pub. No.: WO2012/144800

PCT Pub. Date: Oct. 26, 2012

(65) Prior Publication Data

US 2014/0042918 A1 Feb. 13, 2014

(30) Foreign Application Priority Data

Apr. 19, 2011 (KR) ..... 10-2011-0036191
Jun. 1, 2011 (KR) ..... 10-2011-0052872
Dec. 12, 2011 (KR) ..... 10-2011-0132834

(51) Int. Cl.
*H05B 37/00* (2006.01)
*H05B 33/08* (2006.01)

(52) U.S. Cl.
CPC ..... *H05B 33/0809* (2013.01); *H05B 33/0824* (2013.01)

(58) Field of Classification Search
CPC ..... H05B 37/036
USPC ..... 315/185 R, 291, 294–295, 297, 315/299–300, 302, 307, 312
See application file for complete search history.

(56) References Cited

U.S. PATENT DOCUMENTS

| | | | | |
|---|---|---|---|---|
| 8,384,311 | B2 * | 2/2013 | Gray et al. | 315/307 |
| 8,686,651 | B2 * | 4/2014 | Lynch et al. | 315/192 |
| 8,742,682 | B1 * | 6/2014 | Wang et al. | 315/291 |
| 2007/0145914 | A1 * | 6/2007 | Hong et al. | 315/291 |
| 2008/0197789 | A1 * | 8/2008 | Shiotsu et al. | 315/297 |
| 2010/0194298 | A1 * | 8/2010 | Kuwabara | 315/186 |
| 2010/0308738 | A1 * | 12/2010 | Shteynberg et al. | 315/185 R |
| 2011/0273103 | A1 * | 11/2011 | Hong | 315/193 |

FOREIGN PATENT DOCUMENTS

| | | |
|---|---|---|
| JP | 2011-009474 | 1/2011 |
| KR | 10-20060081902 | 1/2005 |
| KR | 10-20070000963 | 1/2007 |
| KR | 20-2010006345 | 6/2010 |
| KR | 10-0997050 | 11/2010 |
| KR | 10-20100121816 | 11/2010 |

OTHER PUBLICATIONS

International Search Report—PCT/KR2012/002501.
Written Opinion of the International Searching Authority—PCT/KR2012/002501

* cited by examiner

*Primary Examiner* — Jason M Crawford
(74) *Attorney, Agent, or Firm* — Dority & Manning, P.A.

(57) ABSTRACT

In various aspects of the present subject matter, a light emitting diode (LED) driving device and an LED driving method using the same are disclosed.

20 Claims, 16 Drawing Sheets

LED DRIVING DEVICE AND LED DRIVING METHOD USING SAME

CROSS REFERENCE TO RELATED APPLICATIONS

This application is the U.S. National Stage entry of International Application Number PCT/KR2012/002964 filed under the Patent Cooperation Treaty and having a filing date of Apr. 18, 2012, which claims priority to Korean Patent Application Serial Number 10-2011-0036191 having a filing date of Apr. 19, 2011, Korean Patent Application Serial Number 10-2011-0052872 having a filing date of Jun. 1, 2011 and Korean Patent Application Serial Number 10-2011-0132834 having a filing date of Dec. 12, 2011, all of such applications being hereby incorporated herein by reference in their entirety for all purposes.

TECHNICAL FIELD

The present invention relates to a light emitting diode (LED) driving device and an LED driving method using the same, and more particularly, to an LED driving device capable of stably controlling a current flowing in an LED and enhancing power efficiency, and an LED driving method using the same.

BACKGROUND ART

A light emitting device refers to a semiconductor device capable of implementing light of various colors by configuring a light emitting source with various compound semiconductor materials such as GaAs, AlGaAs, GaN, InGaAlP, and the like. Light emitting devices, advantageously having an excellent monochromatic peak wavelength and excellent optical efficiency, being compact and environmentally friendly, and consuming low levels of power, and the like, have been widely used for various applications such as in TVs, computers, illumination devices, vehicles, and the like, and the utilization thereof is gradually expanding.

Recently, organic light emitting device (OLEDs) using organic compounds, rather than inorganic compounds, have been increasingly applied to products. OLEDs, able to be implemented in a large area and easily bendable, are anticipated to be extendedly used in various fields of application.

A light emitting device (such as an LED) has characteristics that a current flowing therethrough is increased exponentially in a voltage (e.g., over a voltage applied to both ends thereof). Thus, in a case in which a lighting device using LEDs as light sources is driven upon receiving direct current (DC) power voltage with fluctuations therein, a constant current circuit generating a constant current or a DC/DC converter maintaining a constant output voltage is generally used. Namely, in an LED, a current is very susceptible to change, with regard to an applied voltage, and thus, in order to apply DC power with large fluctuations therein to an LED and obtain stable optical output, an apparatus or a method for stably controlling a current flowing in an LED is required.

FIG. 1 schematically illustrates a related art LED driving circuit to which alternating current (AC) power is applicable, and voltage and current waveforms of the LED driving circuit. Specifically, FIG. 1A is a view schematically illustrating a related art LED driving circuit, FIG. 1B is a view illustrating a waveform of a voltage $V_{DR}$ applied to a light source unit D and a resistor R in FIG. 1A, and FIG. 1C is a view illustrating a waveform of a current $I_D$ flowing in the light source unit D. First, referring to FIG. 1A, the related art LED driving circuit includes a rectifying unit converting alternating current (AC) power input from the outside into DC power, the light source unit D driven upon receiving a DC voltage output from the rectifying unit and including a plurality of LEDs, and a resistor R connected to the light source unit D in series.

As mentioned above, with respect to an input voltage, a current flowing in an LED is changed exponentially, so the resistor R may be connected to the light source unit D including a plurality of LEDs in series to restrain a change in the current flowing in the light source unit D, and a peak current flowing in the LED may be prevented from being changed exponentially according to fluctuations (e.g., 220Vrms→240Vrms) in the AC power voltage input from the outside due to the resistor R. Here, if a value of the resistor R may be increased, a variation of a peak current flowing in the LED may be reduced but a proportion of power consumed in the resistor R is increased, and a peak current flowing in the LED when a voltage is the highest has a very high value, relative to an average or root mean square (RMS) current, increasing a peak factor (or crest factor). Also, as illustrated in FIG. 1C, since a current flows only in a partial section of the overall period, it may have difficulty in satisfying the International Electrotechnical Commission (IEC) regarding electricity usage, such as power factor as an indicator indicating similarity between an input voltage and a current waveform, a magnitude of a harmonic component (harmonic distortion) included in an input current, and the like. Also, a current flowing in the LED is changed relatively significantly according to a variation of an AC power voltage input from the outside, making it difficult for the LED driving circuit to be applied to a case in which fluctuations in an input power voltage are large.

FIG. 2 is a view illustrating a modification of a related art LED driving circuit that may be applicable to commercial AC power and voltage and current waveforms of the LED driving circuit. Referring to FIG. 2A, the related art LED driving circuit includes a rectifying unit converting AC power input from the outside into DC power, a light source unit D including a plurality of LEDs and driven upon receiving DC power output from the rectifying unit, and a current limiting unit $I_S$ connected to the light source unit D in series to limit a current input to the light source unit D. The current limiting unit $I_S$ operates as a current source only when a forward voltage has a magnitude equal to or greater than a predetermined value in a direction in which a current flows. FIG. 2B illustrates a waveform of a voltage $V_{DR}$ applied to the light source unit D and the current limiting unit $I_S$, and FIG. 2C illustrates a waveform of a current ID flowing in the light source unit D and the current limiting unit $I_S$. In the case of using the current limiting unit $I_S$, the same average value of the current flowing in the light source unit D as that in case of using the resistor R (please see FIG. 1), while lowering a peak value of the current flowing in the light source unit D, can be obtained.

In the LED driving circuit illustrated in FIG. 2, even in the case that a voltage of external AC power is increased (e.g., 220Vrms→240Vrms), the current $I_D$ flowing in the light source unit D is rarely affected. In this case, however, since a current-voltage relationship of the LED appears exponentially, if a voltage across the light source unit D is lower than a predetermined voltage, the current is rapidly reduced and rarely flows. Thus, even in the LED driving circuit illustrated in FIG. 2, in the section P in which the input voltage is lower than a rated voltage of the LED, a current flows rarely, and thus, a waveform of the current $I_D$ of the light source unit D is significantly different from the rectified sinusoidal wave and a peak value of the current $I_D$ is still high, relative to the rectified sinusoidal wave having the same RMS value.

DISCLOSURE

Technical Problem

An aspect of the present invention provides an LED driving device capable of stably controlling a current flowing in an LED simply under an operational condition that an input power supply voltage is greatly changed, and an LED driving method using the same.

An aspect of the present invention also provides an LED driving device capable of enhancing power efficiency and improving a power factor, and an LED driving method using the same.

Technical Solution

According to an aspect of the present invention, there provides an LED driving device comprising: a light source unit including first to nth LED groups by DC power and mutually sequentially connected in series; and a driving control unit including first to nth input terminals sequentially connected to output terminals of the first to nth LED groups, respectively, and sensing currents flowing to a ground through the first to nth input terminals to generate information regarding a driving section to control magnitudes and a path of the currents flowing in the light source unit.

The driving control unit controls a path such that a current is input to one of the first to nth input terminals according to the information regarding the driving section.

The driving control unit controls a path such that a current is input through an input terminal having a highest degree that can be driven in each driving section.

The driving control unit controls a path such that currents are input to the first to nth input terminals of the driving control unit in the first to nth driving sections of the DC source voltage, respectively.

The driving control unit controls a path such that currents are sequentially input from the first to nth input terminals or from the nth input terminal to the first input terminals during a single period of the DC source voltage.

The driving control unit drives a larger current as degrees of the first to nth input terminals are higher.

The driving control unit drives a smaller current as degrees of the first to nth input terminals are higher.

The driving control unit may comprises: a driving section detecting block sensing currents flowing to a ground through the first to nth input terminals from the first to nth LED groups, respectively, to generate information regarding driving sections; a current control block receiving information regarding the driving sections from the driving section detecting block and generating a control signal for controlling magnitudes and a path of the currents input to the driving control unit; and a current driving block adjusting and sensing magnitudes of first to nth input currents input to the first to nth input terminals according to the control signal generated by the current control block, and generating first to nth current sensing signals corresponding to the magnitudes of the first to nth input currents.

The current driving block may comprises: first to nth current control units connected to the first to nth input terminals, respectively, and controlling first to nth input currents into to the first to nth input terminals of the driving control unit according to the control signal generated by the current control block, respectively; and a current sensing unit sensing respective currents flowing to a ground through the first to nth current control units.

At least a portion of the first to nth current control units comprises a bipolar junction transistor (BJT).

At least a portion of the first to nth current control units further comprises a current buffer.

The current sensing unit comprises first to nth current sensing resistors having one end connected to a ground and the other end connected to the first to nth current control units, respectively.

The driving section detecting block generates the information regarding driving sections by determining whether test currents flow through the plurality of input terminals connected to the first to nth input terminals, respectively.

The driving section detecting block comprises a finite state machine (FSM) having different states according to the driving sections.

The FSM changes a state thereof according to magnitudes or variations in currents input to the first to nth input terminals, as input signals.

The driving section detecting block generates information regarding the driving sections according to the magnitudes of the currents input to the first to nth input terminals, as input signals.

The driving section detecting block generates information regarding the driving sections by comparing signals corresponding to the magnitudes of the currents input to the first to the nth input terminals with respective reference signals.

The information regarding the driving sections are transferred as a plurality of signals generated by determining whether the DC source voltage is within a plurality of driving ranges configured to include one or more continued driving sections.

The driving control unit changes the magnitudes of the currents input to the first to nth input terminals upon receiving voltages from output terminals of the first to nth LED groups.

The driving control unit drives a current input to an input terminal of at least one of the first to nth input terminals such that the current has a plurality of levels.

The driving control unit further comprises a dimming signal generator changing magnitudes of first to nth input currents input to the first to nth input terminals upon receiving a dimming signal from the outside.

The dimming signal generator changes magnitudes of at least a portion of the first to nth input currents all in the same proportion.

The LED driving device may further comprising a power supplier supplying a source voltage required for the driving control unit upon receiving the DC power.

The LED driving device may further comprising a temperature sensor transferring a signal for controlling an operation of the light source unit to the driving control unit according to a temperature of the light source unit.

The LED driving device may further comprising a power supply unit supplying DC power to the light source unit, wherein one end of the first LED group is connected to the power supply unit, and the other end thereof is sequentially connected to the second to nth LED groups in series.

A plurality of light source units are connected to an output terminal of the power supply unit in parallel.

The power supply unit comprises a rectifying unit converting AC power input from the outside into DC power and supplying the same to the light source unit.

The LED driving device may further comprising at least one of a line filter and a common mode filter connected between AC power input from the outside and the light source unit.

The LED driving device may further comprising a source voltage regulating unit connected between the rectifying unit and the light source unit, receiving converted DC power from the rectifying unit, regulating a range of a source voltage, and outputting the same.

The source voltage regulating unit is an active power factor corrector (PFC) or a passive PFC.

The driving control unit drives a magnitude of a current flowing through the first LED group such that the magnitude is inverse proportional to a magnitude of the DC source voltage in at least a portion of driving sections.

The light source unit is provided in plural and connected to an output terminal of the source voltage regulating unit in parallel.

The light source unit is provided in plural, and the driving control unit further comprises a current duplication block driving the other remaining light source units not driven by the current driving block, among the plurality of light sources, upon receiving a control signal the same as that of the current driving block from the current control block.

The current duplication block, which drives the other remaining light source units, drives a current having a magnitude the same as that of the current driving block from the output terminals of the first to nth LED groups included in each of the other remaining light source units, respectively.

The current duplication block senses currents input from the output terminals of the first to nth LED groups of the light source unit being driven, respectively.

According to another aspect of the present invention, there provides an LED driving method comprising: setting first to nth continuous driving sections according to magnitudes of DC source voltages and setting first to nth current levels with respect to the first to nth driving sections; sensing first to nth input currents flowing to a ground through first to nth input terminals of a driving control unit from first to nth LED groups mutually sequentially connected in series, respectively, to generate information regarding the driving sections; and driving currents such that the currents flow with first to nth current levels with respect to at least a portion of the first to nth LED groups in the first to nth driving sections according to the information regarding the driving sections.

In the setting of the first to nth current levels, the first to nth current levels are set to have greater values sequentially.

In the setting of the first to nth current levels, the first to nth current levels are set to have smaller values sequentially.

The generating of the information regarding the driving sections comprises sensing voltages obtained when the currents input to the first to nth input terminals flow to a ground through resistors.

The generating of the information regarding the driving sections comprises determining whether test currents flow through the first to nth input terminals.

The generating of the information regarding the driving sections is performed by a finite state machine (FSM) having different states according to the driving sections.

The FSM changes a state thereof according to magnitudes or variations in currents input to the first to nth input terminals, as input signals.

The FSM changes a state thereof according to a clock signal, according to the magnitudes of the currents input from output terminals of the first to nth LED groups to the first to nth input terminals thereof, as input signals.

The information regarding the driving sections is generated according to the magnitudes of the currents input to the input terminals of the first to nth input terminals, as input signals.

The generating of the information regarding the driving sections comprises comparing the signals corresponding to the magnitudes of the currents input to the first to nth input terminals with respective reference signals.

The information regarding the driving sections is generated as a plurality of signals generated by determining whether the DC source voltage is within a plurality of driving ranges configured to include one or more continued driving sections.

In the driving of the currents such that the currents flow with the first to nth current levels with respect to at least a portion of the first to nth LED groups, a path is controlled to allow a current to be input to one of the first to nth input terminals according to the information regarding the driving sections.

In the driving of the currents such that the currents flow with the first to nth current levels with respect to at least a portion of the first to nth LED groups, a path is controlled to allow a current to be input through an input terminal having a highest degree that can be driven in each driving section.

In the driving of the currents such that the currents flow with the first to nth current levels with respect to at least a portion of the first to nth LED groups, a path is controlled to allow currents to flow to a ground through the first to nth input terminals in the first to nth driving sections.

In the driving of the currents such that the currents flow with the first to nth current levels with respect to at least a portion of the first to nth LED groups, a path is controlled to allow currents to sequentially flow from the first LED group to the nth LED group in a half period of the DC source voltage.

In the driving of the currents such that the currents flow with the first to nth current levels with respect to at least a portion of the first to nth LED groups, magnitudes of the current input to the first to nth input terminals are changed upon receiving voltages from output terminals of the first to nth LED groups.

A current input to at least one of the first to nth input terminals is provided to have a plurality of levels.

At least a portion of the currents input from the output terminals of the first to nth LED groups to the first to nth input terminals, respectively, is transferred through a current buffer.

The first to nth current levels are changed by an external signal.

The first to nth current levels are changed all in the same proportion by the external signal in at least a portion of the driving sections.

The LED driving method may further comprise converting AC power input from the outside into DC power in order to drive the first to nth LED groups.

The LED driving method may further comprise reducing a swing of a source voltage upon receiving the DC power.

The reducing of a swing of the source voltage is performed by an active power factor corrector (PFC) or a passive PFC.

A magnitude of a current flowing through the first LED group is driven such that the magnitude is inverse proportional to a magnitude of the DC source voltage in at least a portion of driving sections.

The first to nth current levels are changed according to a temperature of the first to nth LED groups.

Advantageous Effects

According to an embodiment of the present invention, an LED driving device and an LED driving method, having improved power efficiency by minimizing power consumption, can be provided.

Since there is no need to compensate for an influence due to a change in temperature during an operation, or variations in individual LED rated voltages, an LED driving device capable of coping with a change in various operational conditions and an LED driving method using the same can be provided.

Also, according to an embodiment of the present invention, an LED driving device having a lengthened effective operational lifespan can be provided.

BEST MODE

Figure 1A:
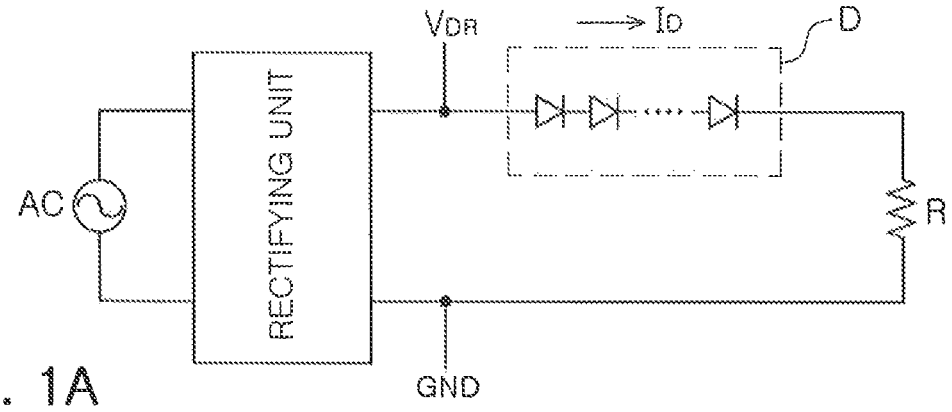
FIG. 1 is a view schematically illustrating a related art LED driving circuit applicable to alternating current (AC) power and voltage and current waveforms of the LED driving circuit.
Figure 1B:
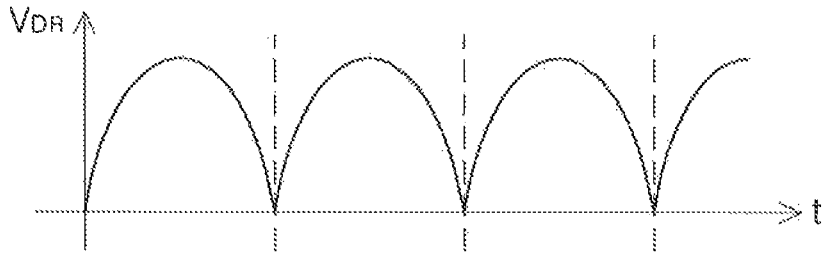
Figure 1C:
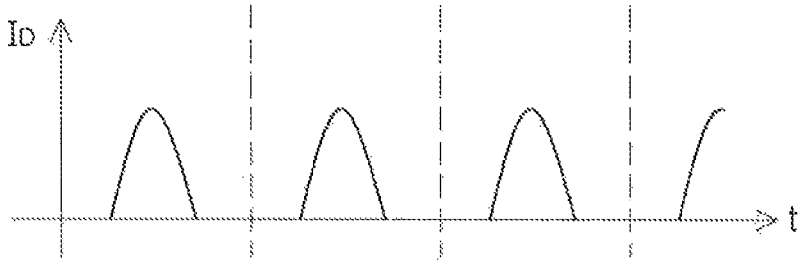
Figure 2A:
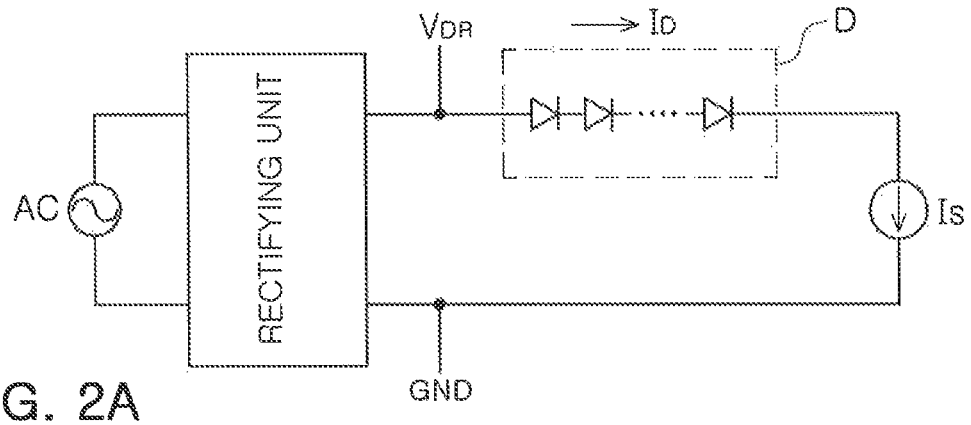
FIG. 2 is a view schematically illustrating a modification of the related art LED driving circuit applicable to AC power and voltage and current waveforms of the LED driving circuit.
Figure 2B:
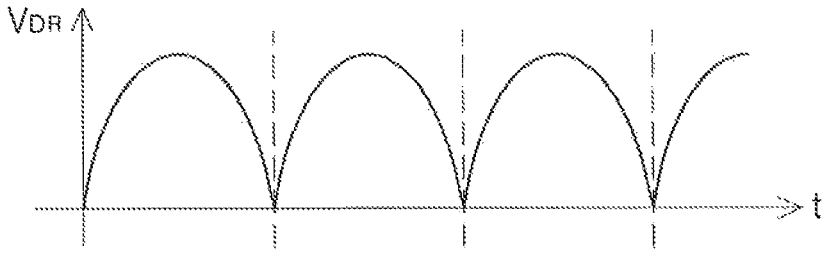
Figure 2C:
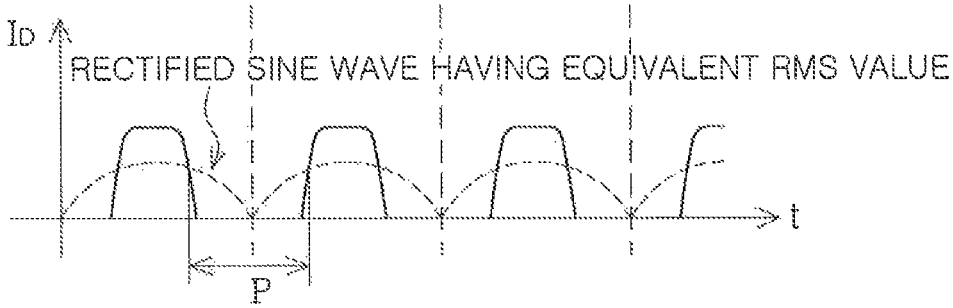

Hereinafter, preferred embodiments of the present invention will be described with reference to the accompanying drawings.

The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

Figure 3:
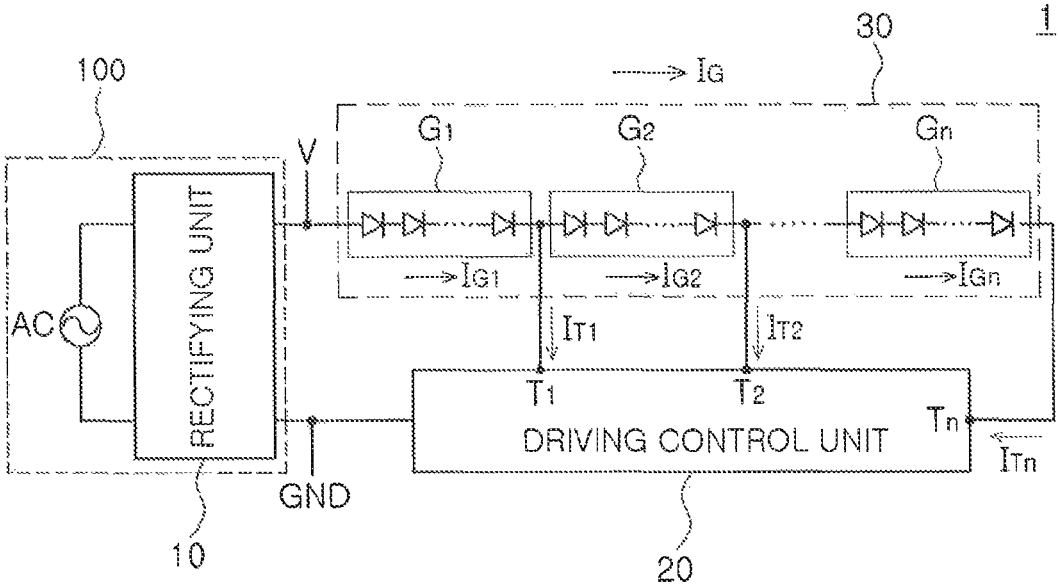
FIG. 3 is a view schematically illustrating a configuration of an LED driving device according to an embodiment of the present invention.

FIG. 3 is a view schematically illustrating a configuration of an LED driving device according to an embodiment of the present invention. Referring to FIG. 3, the LED driving device 1 may include a light source unit 30 driven by direct current (DC) power and including first to nth LED groups G1, G2, . . . , Gn sequentially connected in series, and a driving control unit 20 having first to nth input terminals connected to an output terminal of each of the first to nth LED groups G1, G2, . . . , Gn, and sensing currents flowing to a ground through the first to nth input terminals to generate information regarding a driving section to thereby control a magnitude and path of the current flowing in the light source unit 30.

In detail, the driving control unit 20 may sense first to nth input currents input to the first to nth input terminals from output terminals of the first to nth LED groups G1, G2, . . . , Gn, respectively, to detect a driving section to which the DC source voltage belongs, and control a path such that currents may be input to one of the first to nth input terminals T1, T2, . . . , Tn according to the detected driving section. Also, the driving control unit may control a path such that currents are input to the first to nth input terminals in the first to nth driving sections, respectively, thereby driving currents through the path including LED groups having a high degree that can be driven in each driving section.

Also, the LED driving device 1 according to the present embodiment may further include a rectifying unit 10 converting alternating current (AC) power output from the outside into direct current (DC) power. Power converted into DC by the rectifying unit 10 may be input to the light source unit 30.

The rectifying unit 10 may rectify AC power (e.g., 220 VAC commercial AC power) applied from the outside, and may have a half-bridge structure or a full-bridge structure including one or more diodes. As for DC power output from the rectifying unit 10, the side of the rectifying unit 10 connected to the light source unit 20 is an output terminal having high potential, and the side of the rectifying unit 10 connected to the driving control unit 20 is an output terminal having low potential, and a current flows from the rectifying unit 10 to the driving control unit 20 through the light source unit 30. In the present embodiment, potential of the output terminal of the rectifying unit 10 connected to the driving control unit 20 is regarded as reference potential, i.e., ground GND. It is described that AC power input from the outside is full-wave rectified, but it would be obvious to a person skilled in the art that the present invention is also applicable to a case in which AC power is half-wave rectified.

Unlike the present embodiment, in the LED driving device 1, DC power may be supplied from a power source unit 100, rather than the rectifying unit 10 that converts AC power into DC power.

The power source unit 100 may be a storage battery or a rechargeable battery, or may be a DC power supply device including such a battery or may simply be a DC power source. Besides, the power source unit 100 may be a DC power source that generates electric energy from a different type of energy source such as a solar cell, a DC generator, or the like, and supplies the same, or a DC power supply device including the DC power source, or may be a DC power source that obtains DC power by rectifying AC power, or a DC power supply device including the same. Among output terminals of the power source unit 100, the side connected to the light source unit 30 is an output terminal having high potential, and the side connected to the driving control unit 20 is an output terminal having low potential, which is understood as reference potential, i.e., ground GND. Thus, a current flows from the light source unit 100 to the ground GND through the light source unit 30.

Thus, DC power described in the present embodiment may include an output voltage whose magnitude is periodically changed like a full-wave rectified sinusoidal waveform, as well as an output voltage whose magnitude is constant over time, and a DC power source in the present embodiment may be understood as a DC power supply device including a case in which magnitude of power is changed over time but a polarity thereof is constant, in a broad sense.

In the present embodiment, the light source unit 30 may include first to nth LED groups G1, G2, . . . , Gn sequentially connected in series, and the output terminals of the first to nth LED groups G1, G2, . . . , Gn may be connected to the first to nth input terminals T1, T2, . . . , Tn of the driving control unit 20, respectively. Each of the LED groups G1, G2, . . . , Gn constituting the light source unit 30 may include at least one LED, and may include LEDs having various types of electrical connection including a series connection, a parallel connection, and a serial-parallel connection (a mixture of a series connection and a parallel connection).

Figure 4A:
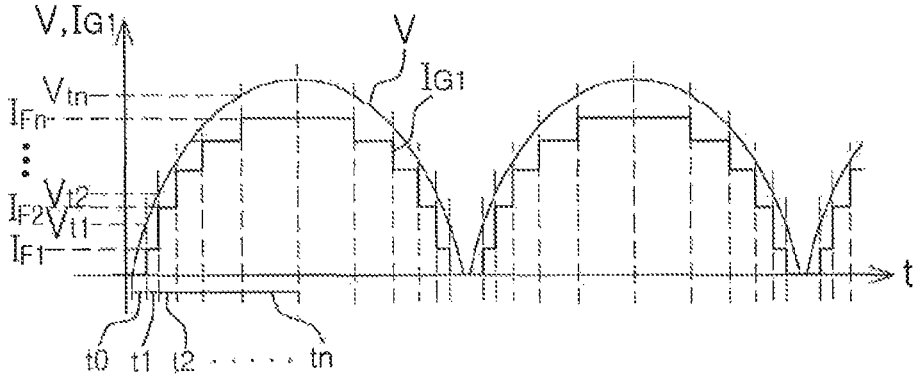
FIG. 4 is a view schematically illustrating waveforms of currents applicable to the LED driving device according to an embodiment of the present invention.
Figure 4B:
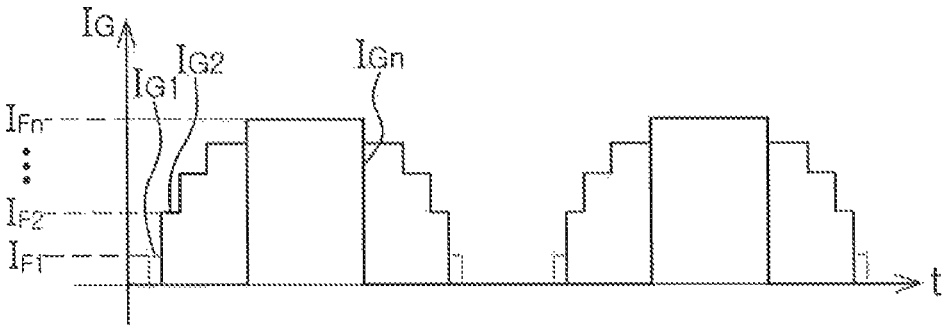
Figure 4C:
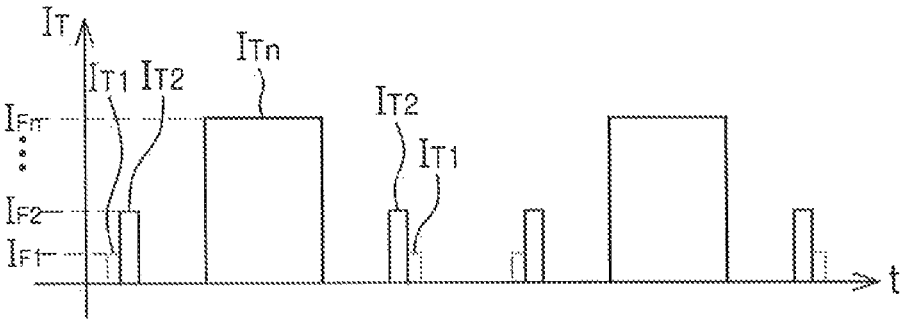

FIG. 4 is a view schematically illustrating waveforms of currents applicable to the LED driving device according to an embodiment of the present invention. Specifically, FIG. 4A illustrates a waveform of a DC source voltage V rectified by the rectifying unit 10 and input to the light source unit 30 and a waveform of a first current IG1, simply, a driving current ($I_G$=$I_{G1}$), flowing in the first LED group G1. FIG. 4B schematically illustrates waveforms of first to nth currents ($I_{G1}$, $I_{G2}$, . . . , $I_{Gn}$) flowing in the first to nth LED groups G1, G2, . . . , Gn. FIG. 4C schematically illustrates waveforms of first to nth input currents ($I_{T1}$, $I_{T2}$, . . . , $I_{Tn}$) input to the first to nth input terminals T1, T2, . . . , Tn of the driving control unit 20.

First, referring to FIGS. 3 and 4A, the DC source voltage V rectified by the rectifying unit 10 and input to the light source unit 30 has a shape of a full-wave rectified sinusoidal wave, and the first LED group G1 connected to a position nearest to the output terminal of the rectifying unit 10 may have a waveform of a current close to the waveform of the rectified DC source voltage V as illustrated in FIG. 4A. Namely, a waveform of the driving current $I_G$ flowing in the light source unit 30 may be set in advance according to the rectified DC source voltage V. In detail, as well as the first to nth driving sections, t1, t2, . . . , tn corresponding to the magnitudes of the DC source voltages, the magnitudes of the currents, i.e., the first to nth current levels $I_{F1}$, $I_{F2}$, . . . , $I_{Fn}$, input to the first to nth input terminals in the respective first to nth driving sections may be arbitrarily set such that the driving currents ($I_G$=$I_{G1}$) having a waveform approximate to a sinusoidal waveform can be obtained. Since the waveform of the first current $I_{G1}$ input to the first LED group G1 is approximate to the full-wave rectified sinusoidal waveform, a power factor (PF) of the AC power input from the outside is improved and a magnitude of a harmonic wave component included in the input AC current can be reduced. In the present embodiment, it is illustrated that the amount of the LED groups G1, G2, . . . , Gn and the amount of the current levels denoted by the first LED group G1 are equal, but the present invention is not limited thereto and it may be designed such that driving currents have the same current level in a plurality of continuous driving sections or that driving currents have a plurality of current levels in a single driving section.

In the present embodiment, as illustrated in FIG. 4, with respect to the plurality of driving sections corresponding to the DC source voltage V, as voltages are increased, they have sequentially higher degrees. Also, the driving sections corresponding to the DC source voltage may also be referred to as driving sections to which the DC source voltage belongs, as driving sections of the DC source voltage, or simply as driving sections.

In detail, when the DC source voltage V is lower than a minimum voltage Vt1 by which the first LED group G1 positioned to be nearest to the rectifying unit 10 can be driven, namely, when the DC source voltage V is in a non-driven section t0, a current cannot flow to any one of the first to nth LED groups G1, G2, . . . , Gn. When the DC source voltage V is higher than the minimum voltage Vt1 at which the first LED group G1 can be driven and lower than a minimum voltage Vt2 at which both the first and second LED groups G1 and G2 can be driven, namely, when the DC source voltage V is in the first driving section t1, the driving control unit 20 may provide control to allow the first input current IT1 to be input to the first input terminal T1, so the first current IG1 flowing in the first LED group G1 is the same as the first input current IT1 input to the first input terminal T1.

Next, when the DC source voltage V is higher than the minimum voltage Vt2 at which both the first and second LED groups G1 and G2 can be driven and lower than a minimum voltage at which all of the first to third LED groups G1, G2, and G3 can be driven, namely, when the DC source voltage V is in the second driving section t2, the driving control unit 20 may cut off a current input to the first input terminal T1 and provide control to allow the second input current IT2 to be input to the second input terminal T2, so a driving current ($I_{G1}$=$I_{G2}$=$I_{T2}$) having the same magnitude as that of the second input current IT2 may flow to the first and second LED groups G1 and G2. In the same manner, in the nth driving section tn in which a magnitude of the DC source voltage V is the greatest, the driving control unit 20 cuts off a current input to the first to (n−1)th input terminals T1, T2, . . . , Tn−1, and provides controlling to allow the nth input current ($I_{Tn}$) to be input to the nth input terminal Tn, whereby the nth input current ($I_{Tn}$=$I_{G1}$=$I_{G2}$ . . . =$I_{Gn}$) flows to the first to nth LED groups G1, G2, . . . , Gn, and thus, the first LED group G1 positioned to be nearest to the power source unit 10 may have a driving current (IG=IG1) waveform the same as that illustrated in FIG. 4A.

Waveforms of the first to nth currents ($I_{G1}$, $I_{G2}$, . . . , $I_{Gn}$) flowing in the respective LED groups G1, G2, . . . , Gn will be described with reference to FIG. 4B. The first LED group G1 is driven in the first to nth driving sections (t1, t2, . . . , tn), so it has the same waveform as that of the first current IG1 of FIG. 4A. Meanwhile, the second LED group G2 may be driven only in the second to nth driving sections t2, . . . , tn, so it has a current waveform the same as that of the first current $I_{G1}$ in the regions excluding the first driving section t1. Similarly, the nth LED group Gn can be driven only in the nth driving section tn, it may have a current waveform the same as that of the nth current $I_{Gn}$ illustrated in FIG. 4B.

Meanwhile, in order to make the first to nth LED group G1, G2*n*, . . . , Gn have the current waveform illustrated in FIG. 4B, a magnitude of a current input to the first to nth input terminals T1, T2, . . . , Tn of the driving control unit 20 and a driving point in time thereof may be controlled, as illustrated in FIG. 4C. Referring to FIG. 4C, by controlling a first input current $I_{T1}$ to be input to the first input terminal T1 of the driving control unit 20 in the first driving section t1, a second input current $I_{T2}$ to be input to the second input terminal T2 in the second driving section t2, and the nth input current $I_{Tn}$ to be input to the nth input terminal Tn in the nth driving section tn, the first, second, and nth input currents $I_{T1}$, $I_{T2}$, and $I_{Tn}$ may be driven in the first LED group G1, the first and second LED groups G1 and G2, and the first to nth LED groups G1, G2, . . . , Gn, respectively, in the respective driving sections.

Thus, the driving control unit 20 according to the present embodiment may control a path such that currents are sequentially input from the first input terminal to the nth input terminal and from the nth input terminal to the first input terminal during one period of the DC source voltage V.

Referring to degrees in relation to the present invention, degrees of the first to nth driving sections t1, t2, . . . , tn may be understood as corresponding to the amount of LED groups sequentially connected in series and driven by the DC source voltage V. The degrees of the LED groups sequentially connected in series to the DC power source may be considered to correspond to the amount of LED groups between the power source unit 100 and the output terminals of the respective LED groups. Also, the input terminals of the driving control unit 20 have the same degrees as those of the LED groups to which the input terminals are connected, respectively. Namely, when two LED groups G1 and G2 are sequentially connected to the DC power source, a degree of the LED group G1 directly connected to the DC power source is 1, so the LED group is referred to as the first LED group G1, since a degree of the LED group G2 connected to the output terminal of the first LED group G1 is 2, the LED group is referred to as the second LED group. Also, the input terminal T1 of the driving control unit 20 connected to the output terminal of the first LED group G1 has a degree of 1, so it is referred to as a first input terminal. Hereinafter, unless otherwise mentioned, when a specific driving section, a specific LED group, a specific input terminal of a driving controller, an input current input to a specific input terminal, and a level of a specific input current are mentioned, a degree will be attached in front thereof to be referred to as a first driving section t1, a first LED group G1, a first input terminal T1, a first input current $I_{T1}$, or a first current level $I_{F1}$.

Referring to an operational principle of the LED driving device according to an embodiment of the present invention with degrees applied thereto, it may be summarized as follows. Namely, in the LED driving device according to an embodiment of the present invention, when the DC source voltage V is in the nth driving section tn, a current magnitude and path may be controlled such that the nth input current input to the nth input terminal of the driving controller from the output terminal of the nth LED group is driven at the nth current level. Also, in case of driving a plurality of LED groups mutually connected in series according to a change in the DC source voltage V, power required for obtaining a predetermined amount of optical power can be minimized by allowing a current to flow along a path including the highest degree of LED groups that can be driven in each driving section. The present invention provides a means and method for determining a path of a driving current such that the highest degree of power efficiency can be obtained in each driving section.

Figure 5:
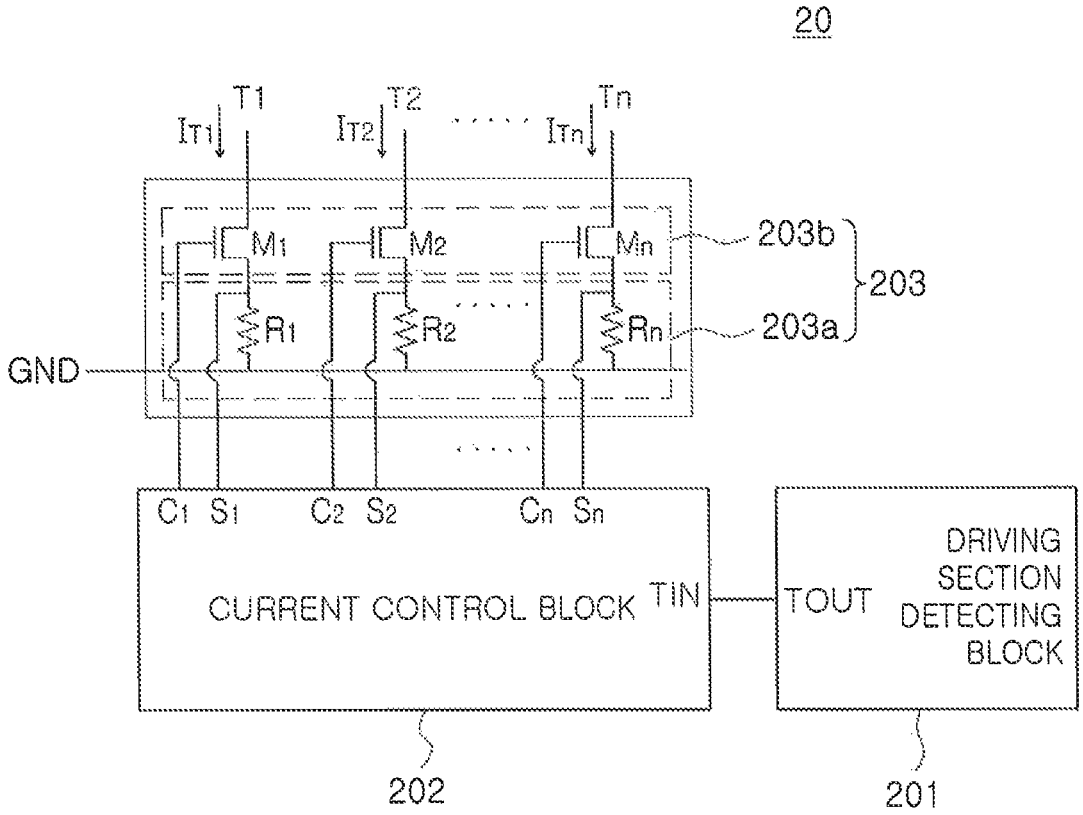
FIG. 5 is a view schematically illustrating a configuration of a driving control unit applicable to the LED driving device according to an embodiment of the present invention.

FIG. 5 is a view schematically illustrating a configuration of a driving control unit applicable to an LED driving device according to an embodiment of the present invention. Referring to FIG. 5, the driving control unit 20 according to the present embodiment may include a driving section detecting block 201 detecting a driving section of the DC source voltage V and generating information regarding the driving section, a current control block 202 generating a control signal for controlling a magnitude of a current input to the driving control unit 20 and a path thereof, and a current driving block 203 regulating magnitudes of first to nth input currents $I_{T1}$, $I_{T2}$, . . . , $I_{Tn}$ input to the first to nth input terminals T1, T2, . . . , Tn of the driving control unit 20 and sensing the same upon receiving the control signal.

The driving section detecting block 201 may sense currents flowing to a ground through the first to nth input terminals T1, T2, . . . , Tn of the driving control unit to detect a driving section of the DC source voltage and generate information regarding the driving section. Upon receiving a control signal output from the current control block 202, the current driving block 203 drives the first to nth input currents $I_{T1}$, $I_{T2}$, . . . , $I_{Tn}$ input to the first to nth input terminals, respectively, and outputs first to nth current sensing signals corresponding to magnitudes of the first to nth input currents to the current control block 202. Meanwhile, the current control block 202 may receive the information regarding the driving section from the driving section detecting block 201 and receive the first to nth current sensing signals from the current driving block 203, and output a control signal for controlling magnitudes of currents input to the driving control unit 20 and paths thereof.

In the present embodiment, the current driving block 203 may include a current sensing unit 203*a* sensing magnitudes of the first to nth input currents $I_{T1}$, $I_{T2}$, . . . , $I_{Tn}$ input to the first to nth input terminals T1, T2, . . . , Tn and a current control unit 203*b* adjusting the magnitudes of the first to nth input currents according to the control signal generated by the current control block 202.

Referring to FIG. 5, the current sensing unit 203*a* may include first to nth current sensing resistors R1, R2, . . . , Rn connected between an output terminal of the current control unit 203 and a ground and sensing first to nth input currents, respectively. In this case, magnitudes of the first to nth input currents $I_{T1}$, $I_{T2}$, . . . , $I_{Tn}$ may appear as voltages. By grounding one end of each of the first to nth current sensing resistors R1, R2, . . . , Rn, voltages obtained from the other ends thereof connected to the output terminal of the current control unit 203 may be the first to nth current sensing signals corresponding to the magnitudes of the first to nth input currents. However, the present inventive concept is not limited thereto.

The current control unit 203*b* may include first to nth current control units M1, M2, . . . , Mn connected to the first to nth input terminals of the driving control unit 20, respectively, and adjusting magnitudes of the first to nth input currents input to the first to nth input terminals according to a control signal input from the current control block 202, respectively. The first to nth current control units M1, M2, . . . , Mn may be implemented as MOSFETs (M1, M2, . . . , Mn) to adjust magnitudes of driving currents, but the present inventive concept is not limited thereto and the first to nth current control units M1, M2, . . . , Mn may be implemented as current control elements such as bipolar junction transistors (BJTs), insulated gate bipolar transistors (IGBTs), junction gate field-effect transistors (JFETs), double-diffused metal-oxide-semiconductor field-effect transistors (DMOSFETs), and the like, or a combination thereof. Namely, the first to nth current control units may be implemented to include one or more current control elements such as general transistors, or the like. Among these, a BJT or a current control unit including a BJT has a high degree of transconductance, so it is advantageous for controlling a current. Also, each of the current control units M1, M2, . . . , Mn may be implemented as a single current control element, may be implemented to further include an amplifier, or may be implemented to further include different current control elements connected in a cascade manner in a path along which a current flows.

When a different current control element is further connected in a cascade manner in a path along which a current flows to serve as current buffer, the current control element receiving a control signal may not be directly connected to an output terminal of the LED group and may receive a current through the different current control element serving as a current buffer, so that a voltage applied to an input terminal connected to the current buffer may be limited by the current buffer. This type is a circuit configuration scheme well known as a cascode or cascade amplifier. When a current control unit is configured to have a cascode structure, circuits other than the current buffer directly connected to the light source unit 30 may operate at a low voltage, so the current control unit may be implemented with an element having a low operational voltage. When circuits including only an element having a low operational voltage are integrated, manufacturing costs can be lowered. Also, the entirety or a portion of an LED group including a component to which a high voltage is applied, i.e., a single current buffer, may be integrated into a single component. In this case, the size of the component is reduced to enhance user convenience and lower manufacturing costs. Various known circuit design techniques may be applied to implement a current control unit.

The current control block 202 may receive the first to nth current sensing signals corresponding to the magnitudes of the first to nth input currents $I_{T1}$, $I_{T2}$, . . . , $I_{Tn}$ from the current driving block 203 through a plurality of input terminals S1, S2, . . . , Sn, and may output a control signal to the current control unit 203*b* through a plurality of output terminals C1, C2, . . . , Cn according to an input signal to control a current flowing to a ground through the current control unit 203*b*. In this case, the current control block 202 may receive the information regarding a driving section from the driving section detecting block 201 to determine a magnitude of an input current and a path thereof in each driving section. A method for detecting a driving section by the driving section detecting block 201 will be described below with reference to an embodiment of FIGS. 6 through 9.

Figure 6:
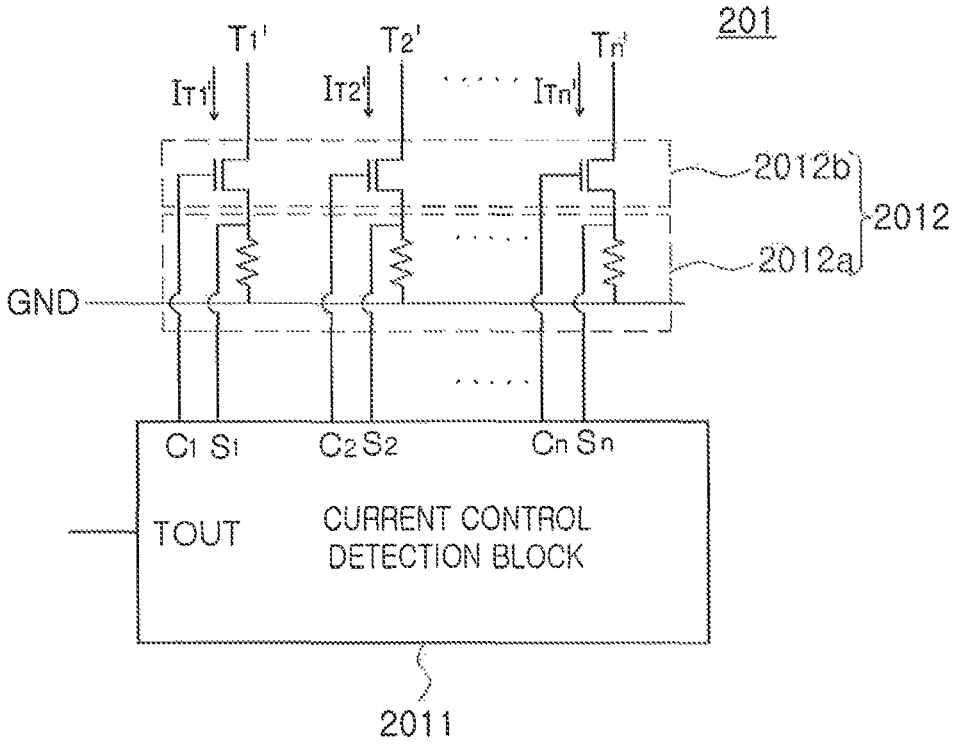
FIG. 6 is a view schematically illustrating a configuration of a driving section detecting block applicable to the driving control unit of the LED driving device according to an embodiment of the present invention.

FIG. 6 is a view schematically illustrating a configuration of a driving section detecting block applicable to the driving control unit of the LED driving device according to an embodiment of the present invention. Referring to FIG. 6, the driving section detecting block 201 according to the present embodiment may sense a test current flowing to a ground through the plurality of input terminals connected to the first to nth input terminals T1, T2, . . . , Tn of the driving control unit 20 to detect driving sections t0, t1, . . . , tn, and transfer information regarding the driving sections to the current control block 202, thereby allowing the magnitude of the current flowing in the light source unit 30 and a path thereof to be controlled. The driving section detecting block 201 according to the present embodiment may include a current control sensing unit 2012 including a current sensing unit 2012*a* and a current control unit 2012*b*, and a current control detection block 2011 receiving a current sensing signal corresponding to a magnitude of the test current from the current control sensing unit 2012 and output a control signal to allow a test current having a pre-set magnitude to flow from the current control sensing unit 2012, and detect a driving section by determining whether a test current is flowing through the received current sensing signal, and generate corresponding information.

In detail, the driving section detecting block 201 according to the present embodiment may include first to nth input terminals T1', T2', . . . , Tn' connected to the first to nth input terminals T1, T2, . . . , Tn of the driving control unit, and determine whether predetermined test currents $I_{T1}'$, $I_{T2}'$, . . . , $I_{Tn}'$ flow through the first to nth input terminals T1', T2', . . . , Tn' to detect a driving section of the DC source voltage V.

Referring back to FIGS. 3 and 4, when the DC source voltage V is in the non-driving section t0, a current cannot flow to any of the first to nth LED groups G1, G2, . . . , Gn, so test currents do not flow through any one of input terminals T1', T2', . . . , Tn' of the driving section detecting block 201. When the DC source voltage is in the first driving section t1, since a difference in potential exists between the first input terminal T1' of the driving section detecting block 201 connected to the first input terminal T1 of the driving control unit 20 and a ground GND, a test current only flows through the first input terminal T1'.

Next, when the DC source voltage is in the second driving section t2, since a difference in potential exists between the first and second input terminals T1' and T2' of the driving section detecting block 201 connected to the first and second input terminals of the driving control unit 20 and a ground GND, a test current flows through the first and second input terminals T1' and T2', and similarly, in the nth driving section tn having the highest DC source voltage V, a difference in potential exists between all the input terminals T1', T2', . . . , Tn' of the driving section detecting block 201 connected to the first to nth input terminals of the driving control unit 20 and the ground GND, so a test current may flow to a ground through all the first to nth input terminals T1', T2', . . . , Tn'.

Thus, the driving section detecting block 201 may detect a driving section of the DC source voltage V by sensing a test current flowing through the first to nth input terminals T1', T2', . . . , Tn', and transfer information regarding the detected driving section to the current control block 202 to allow the current control block 202 to control a magnitude of a current input to the driving control unit and a path thereof. Here, since the first to nth input terminals T1', T2', . . . , Tn' of the driving section detecting block 201 are connected to the first to nth input terminals T1, T2, . . . , Tn of the driving control unit 20, respectively, a current flowing to a ground through the nth input terminal Tn' of the driving section detecting block 201 may be a current which has been input through the nth input terminal Tn of the driving control unit 20. Thus, it may be said that the driving section detecting block 201 detects a driving section by sensing a test current flowing to a ground through the first to nth input terminals T1, T2, . . . , Tn of the driving control unit 20.

In the present embodiment, the current control sensing unit 2012 has a configuration similar to that of the current driving block 203 constituting the driving control unit 20, but since a purpose and function thereof are different, the current control sensing unit 2012 should be separately configured. Also, a test current driven in the current control sensing unit 2012 may be set to have a value sufficiently smaller than the driving current $I_G$ that flows through the first to nth LED groups G1, G2, . . . , Gn in order to minimize power consumption in the driving section detecting block 201 without affecting the driving current $I_G$.

Figure 7:
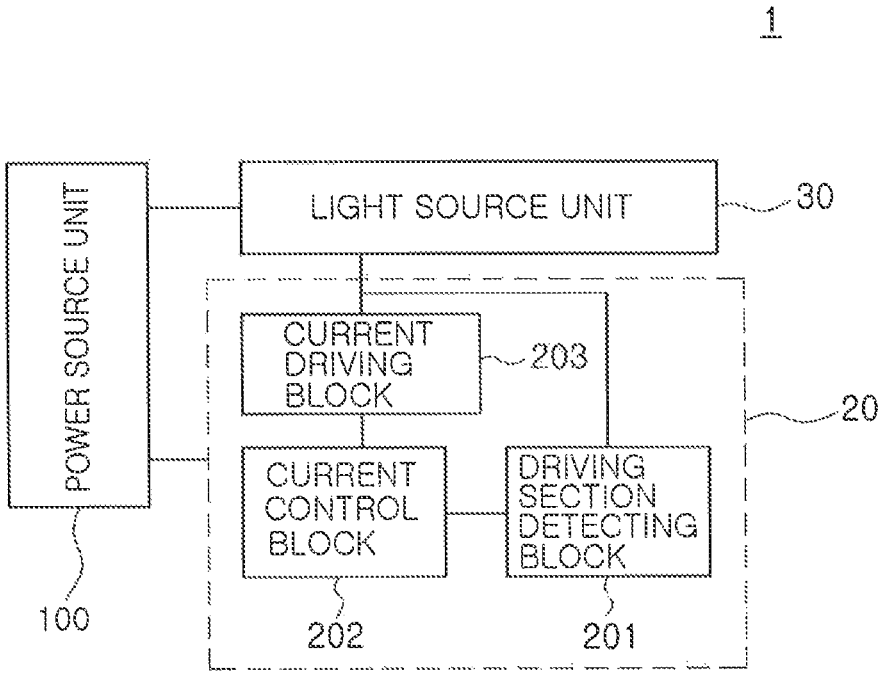
FIG. 7 is a block diagram schematically illustrating an LED driving device 1 employing the driving section detecting block 201 of FIG. 6.

FIG. 7 is a block diagram schematically illustrating an LED driving device 1 employing the driving section detecting block 201 illustrated in FIG. 6. Referring to FIG. 7, the LED driving device 1 according to the present embodiment may include a light source unit 30 driven by direct current (DC) power and including first to nth LED groups sequentially connected in series, and a driving control unit 20 sensing currents flowing to a ground through first to nth input terminals connected to output terminals of the first to nth LED groups, respectively, to detect a driving section of the DC source voltage to thereby control a magnitude of a driving current flowing in the light source unit 30 and a path thereof. The driving control unit 20 may include a driving section detecting block 201 detecting a driving section of the DC source voltage by sensing currents flowing to a ground through the first to nth input terminals, and generating information regarding the detected driving section, a current control block 202 generating a control signal for controlling a magnitude of a current input to the driving control unit and a path thereof according to the information regarding a driving section, and a current driving block 203 driving currents through the first to nth input terminals according to the current control signals and sensing magnitudes thereof.

The driving section detecting block 201 illustrated in FIG. 6 may be applied in the present embodiment, and as illustrated in FIG. 7, the driving section detecting block 201 may be connected to the first to nth input terminals of the driving control unit 20 to determine whether a test current is flowing to the first to nth input terminals of the driving control unit 20 to detect a driving section of the DC source voltage.

According to the present embodiment, since driving sections are continuously recognized through the driving section detecting block 201, a magnitude and a path of a driving current are changed when a voltage required for driving a different LED group (e.g., Vt2 in case of the second LED group G2 in FIG. 4) is minimized. Thus, the LED driving device according to the present embodiment can obtain an effect of reducing power consumption.

In addition, in the case of the present embodiment, although a voltage-current relationship of the light source unit 30 is slightly changed, since the driving control unit 20 drives the light source unit by reflecting the change in a driving section, an influence thereof on the operation of the LED driving device is insignificant. Thus, it may also be applied, even to a case in which a rated voltage of the LEDs constituting the plurality of LED groups G1, G2, . . . , Gn has a relatively large distribution. Also, since a change in an LED rated voltage due to a change in temperature may be reflected in a driving section in the event of driving, it may be used in a large temperature range although an influence due to a temperature change is not compensated.

According to an embodiment of the present invention, both driving sections of a DC source voltage and current levels with respect to the driving section may be arbitrarily set by a designer. Thus, restrictions on operational conditions of the LED driving device or electrical characteristics of respective LEDs constituting the plurality of LED groups are not great. For example, in an LED driving device operating at 220 Vrms, the amount of LEDs constituting each LED group may be halved to reduce a rate voltage of each LED group by half to have 110Vrms of power applied thereto. When an external source voltage is changed, driving sections may be reset without altering the driving control unit, thus easily coping therewith. Also, the LED driving device according to the present embodiment is not required to use an electrolytic capacitor which has a large capacity but has a short lifespan to stabilize a DC source voltage, obtaining an effect of lengthening a lifespan of the LED driving device.

Figure 8:
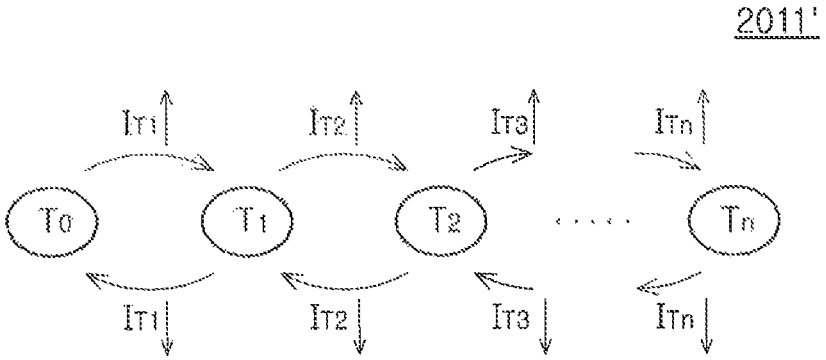
FIG. 8 is a schematic state transition diagram of a finite state machine (FSM) applicable to the driving control unit of the LED driving device according to an embodiment of the present invention.

FIG. 8 is a view schematically illustrating an operating scheme of a different driving section detecting block applicable to the driving control unit of the LED driving device according to an embodiment of the present invention. A driving section detecting block 201' according to the present embodiment may be implemented as including a finite state machine (FSM), and specifically, FIG. 8 is a state transition diagram of an FSM applicable to the present embodiment. An FSM is a device devised to have various states able to be changed from a current state (i.e., a present state) into a different state, according to an input signal. In general, in the case of using an FSM, an operation to be performed for each state is determined. In the present embodiment, it may be a magnitude and a path of a current to be driven in each state.

Referring to FIG. 8, states of an FSM applied to the driving section detecting block 201' according to the present embodiment may be denoted by T0 to Tn. T0 is a state in which the DC source voltage V is in a non-driving section t0, and in this state, a current is not provided to any input terminal of the driving control unit. T1 is a state in which the DC source voltage V is in the first driving section t1, and in this state, a current is driven at a first current level $I_{F1}$ through the first input terminal T1 of the driving control unit 20. T2 is a state in which the DC source voltage is in the second driving section t2, and in this state, the driving control unit 20 cuts off a current of the first input terminal T1 and allows a current having a second current level $I_{F2}$ to flow through the second input terminal T2. Tn is a state in which the DC source voltage V is in the nth driving section tn to drive the first to nth LED groups G1, G2, . . . , Gn, and in this state, the driving control unit 20 cuts off all of the currents input to the first to (n−1)st input terminals T1, T2, . . . , Tn−1 and allows a current having an nth current level $I_{Fn}$ to be input to the nth input terminal Tn, whereby the nth input current $I_{Tn}$ flows to all of the first to nth LED groups G1, G2, . . . , Gn. Referring to FIG. 8, when the FSM is in the state T0, if the first input current $I_{T1}$ is rapidly increased, the state of the FSM is changed to T1, and when the FSM is in the state T1, if the first input current $I_{T1}$ is decreased rapidly, the state of the FSM may be changed to T0.

Figure 9:
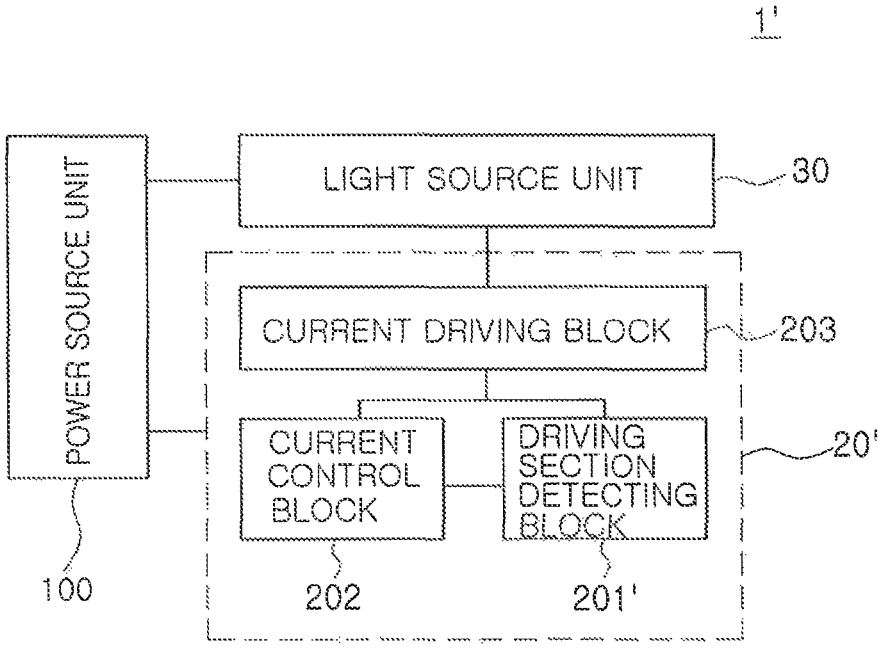
FIG. 9 is a block diagram schematically illustrating a driving control unit of the LED driving device employing the FSM of FIG. 8.

FIG. 9 is a block diagram schematically illustrating an LED driving device 1' employing a driving section detecting block 201' including the FSM of FIG. 8. In the block diagram of FIG. 9, a driving control unit and an input terminal of the driving control unit are not specifically illustrated but they may be understood as being similar to those of FIG. 5. According to the present embodiment, as the DC source voltage V is increased or decreased, the current driving block 203 generates a plurality of current sensing signals corresponding to magnitudes of currents input to respective input terminals of the driving control unit 20', and, unlike the driving section detecting block 201 of FIG. 7, the driving section detecting block 201' receives the plurality of current sensing signals, and when a magnitude of any one of the plurality of current sensing signals is rapidly increased or decreased, a state of the FSM may be changed. Namely, a state of the FSM may be changed at a point in time at which a current is rapidly increased or decreased in any one of the first to nth input terminals T1, T2, . . . , Tn of the driving control unit 20', or at a point in time at which a current is increased to be higher than a pre-set magnitude or decreased to be lower than a pre-set magnitude in any one of the input terminals T1, T2, . . . , Tn.

According to the present embodiment, unlike the driving section detecting block 201 illustrated in FIG. 6, the driving section detecting block 201' receives a plurality of current sensing signals corresponding to the magnitudes of the input currents $I_{T1}, I_{T2}, \ldots, I_{Tn}$ output from the current driving block 203 to sense a change in the input current, to thus recognize a change in a driving section, rather than continuously recognizing which driving section the DC source voltage exists in. In this case, a signal input to the FSM may be generated according to a variation in a current flowing to a ground through the current driving block 203 over time, or a magnitude of a current may be compared with a pre-set reference and when a relative magnitude is equal to or greater than 1, the signal input to the FSM may be generated. A state of the FSM may be changed into a new state immediately when an input signal is changed, and the FSM may remain in the same state and continuously output information regarding a driving section reflecting the corresponding state to the current control block 202, until a new input signal is input thereto. Here, like a case of detecting a driving section by continuously sensing test currents, the current control block 202 may control a magnitude of a current input to the driving control unit and a path thereof. Thus, in the LED driving device 1' according to the present embodiment, magnitudes and paths of the currents flowing through the first to nth LED groups G1, G2, . . . , Gn may be changed at a point in time at which a driving section is changed according to the DC source voltage, without delay.

In order to change a state of the FSM, a plurality of current sensing signals input from the current driving block 203, namely, signals corresponding to magnitudes of the first to nth input currents flowing to a ground through respective input terminals of the driving control unit 20, may be used. In this case, the FSM may be designed such that a state thereof is changed to a new state by reflecting the plurality of current sensing signals at predetermined time intervals according to a clock signal. In this case, the driving section detecting block 201' may detect a driving section to which the DC source voltage V belongs in every period of the clock signal, and output information regarding the driving section to the current control block 202.

When the driving section detecting block 201' including the FSM is applied to the LED driving device 1', in order to detect the DC source voltage V changing to a driving section having a higher degree, the current control block 202 should open a path in advance to allow a current to flow to an input terminal (e.g., T2 of FIG. 3) having a next degree driven at the higher DC source voltage V besides the input terminal (e.g., T1 of FIG. 3) that drives the current. The reason is because a magnitude of a current input through an input terminal of a next degree driven with a higher DC source voltage or a variation thereof is used as an input signal of the FSM. Meanwhile, in the case of the driving section detecting block 201 illustrated in FIG. 6, there is no need to open an input terminal other than the input terminal that drives a current, but a path of a current may be open in advance like the case of using the FSM.

Hereinafter, another embodiment in which information regarding the driving sections is generated by using a plurality of current sensing signals output from the current driving block 203 as input signals as illustrated in FIG. 9 will be described.

Information regarding the driving sections may be delivered as a plurality of signals generated by determining whether the DC source voltage V belongs to a plurality of driving ranges configured to include one or more continuous driving sections. Here, the driving ranges, namely, ranges of the driving sections, refer to one or more continuous driving sections. For example, the driving ranges may be [t1], [t2], [tn], [t1, t2], [t1~tn], and [t2~tn]. Symbols used to illustrate the driving ranges are as follows. A pair of square brackets denotes a single driving range. Commas are used to differentiate between a plurality of driving sections, and a swung dash (~) is used to omit driving sections other than first and last driving sections. The order of arranging driving sections in a pair of square brackets is irrelevant, and the first and last thereof may be interchanged. Namely, all of [t0, t1, t2], [t2, t0, t1], [t0~t2], and [t2~t0] denote the same driving range.

In the present embodiment, whether the DC source voltage is within a particular driving range, e.g., [t2~tn] may be determined by comparing the second to nth current sensing signals, among the plurality of current sensing signals, i.e., the first to nth current sensing signals, output from the current driving block 203 with respective reference signals. Namely, when at least one of the second to nth current sensing signals is greater than the respective reference signals, the DC source voltage may be determined to be within the range from the second to nth driving sections. In this case, information regarding driving sections may be continuously detected over time.

Meanwhile, according to whether the DC source voltage is within the range [t2~tn] of the second to nth driving sections, the current control block 202 may cut off the first input current $I_{T1}$ input to the first input terminal of the driving control unit 20 or the first input current $I_{T1}$ may be driven at the first current level $I_{F1}$. Similarly, according to whether the DC source voltage is within the range [t3~tn] of the third to nth driving sections, the current control block 202 may cut off the second input current $I_{T2}$ or the second input current $I_{T2}$ may be driven at the second current level $I_{F2}$. Similarly, according to whether the DC source voltage is within the nth driving section tn, the current control block 202 may cut off the (n−1)st input current $I_{Tn-1}$ or the (n−1)st input current $I_{Tn-1}$ may be driven at the (n−1)st current level. Meanwhile, since the nth input terminal can drive a current only in the nth driving section, a control signal for continually driving a current at the nth current level $I_{Fn}$ may be output.

For example, when the DC source voltage is in the second driving section t2, the DC source voltage V is within the driving range [t2~tn] of the second to nth driving sections, and thus, the current control block 202 cuts off an input current input to the first input terminal T1. Meanwhile, since the DC source voltage V is not within the range [t3~tn] of the third to nth driving sections, a current having a pre-set magnitude is provided to the second input terminal T2. Similarly, since the DC source voltage V is not within the nth driving section, a current having a pre-set magnitude is provided to the (n−1)st input terminal. A current of the final nth input terminal has a pre-set magnitude continuously, regardless of a driving section. However, in a case in which the DC source voltage V is in the second driving section t2, although the current control block 202 outputs a control signal for driving an input current, a current cannot be provided to the third to nth input terminals, and since the current input to the first input terminal t1 is cut off, a current may be driven at the second current level $I_{F2}$ only through the second input terminal T2 of the driving control unit 20.

As described above, information regarding driving sections according to the present embodiment is not determined as being any one of t0, t1, . . . , tn and transferred, but may be transferred as a plurality of signals generated by determining whether the DC source voltage is within a plurality of driving ranges such as the range from the second to nth driving sections [t2~tn], the range from the third to nth driving sections [t3~tn], the range of the nth driving section [tn], and the like. The embodiment of transferring information regarding driving sections is one method of expressing information regarding driving sections and irrelevant to a configuration of operating method of the driving section detecting blocks 201 and 201'. Thus, it may be applicable to the driving control unit 20, as well as to the driving control unit 20' illustrated in FIG. 9.

Figure 10:
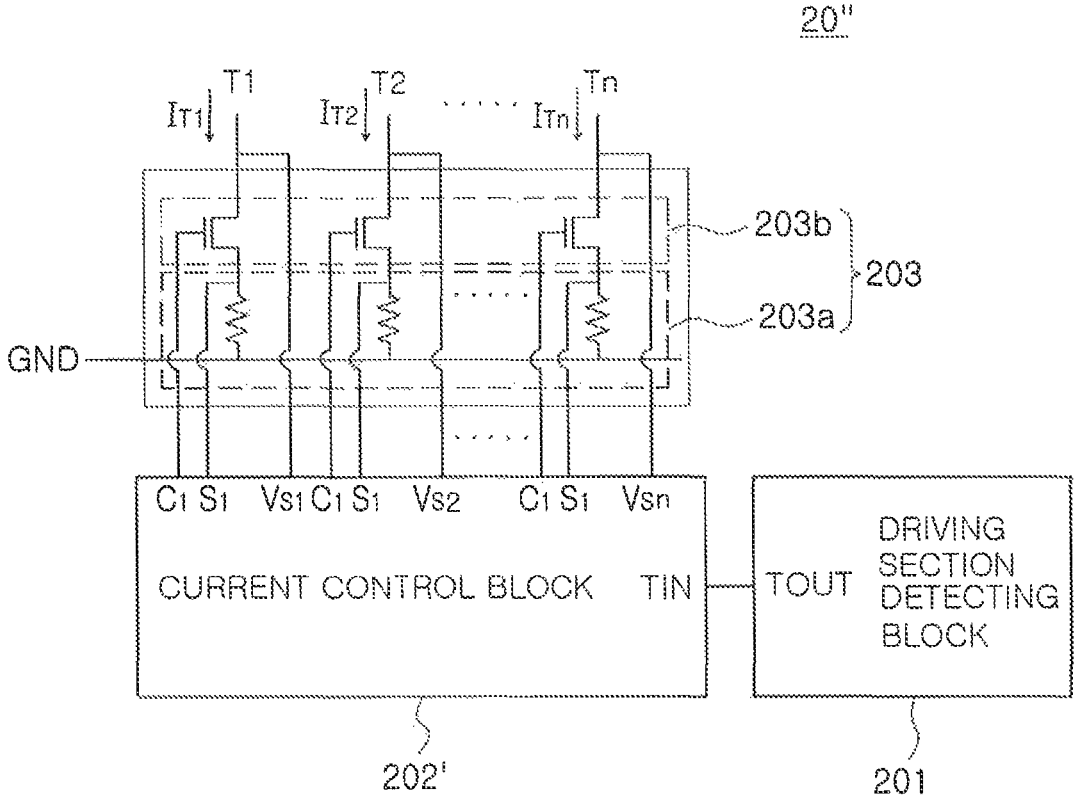
FIG. 10 is a view schematically illustrating a modification of the driving control unit applicable to the LED driving device according to an embodiment of the present invention.

FIG. 10 is a view schematically illustrating a modification of a driving control unit applicable to an LED driving device according to an embodiment of the present invention. Unlike the embodiment illustrated in FIG. 5, in a driving control unit 20" according to the present embodiment, magnitudes of currents flowing to a ground through the first to nth input terminals may be changed by reflecting voltages of the output terminals of the first to nth LED groups through the first to nth input terminals T1, T2, . . . , Tn of the driving control unit. In detail, voltages of the output terminals of the first to nth LED groups G1, G2, . . . , Gn connected to the first to nth input terminals T1, T2, . . . , Tn may be received through the plurality of input terminals VS1, VS2, . . . , VSn in the current control block to continuously change driving currents flowing in the first to nth LED groups G1, G2, . . . , Gn or to change the driving currents to have a plurality of levels rather than a single level in a single driving section. When the foregoing driving method is applied, a current may be driven such that the current waveform $I_{G1}$ of the first LED group G1 is approximate to a sine wave.

In a different embodiment in which the LED driving is applied, a current may be provided to be in inverse proportion to a magnitude of the DC source voltage V in one driving section or in a portion thereof. An effect of driving the DC source voltage and a driving current such that magnitudes thereof are in inverse proportion, respectively will be described in a different embodiment.

In the present embodiment, when the LED driving device is driven in a state in which voltages of the output terminals of the first to nth LED groups G1, G2, . . . , Gn, namely, the voltages of the first to nth input terminals of the driving control unit, are higher than a normal range (e.g., when the LED driving device manufactured for 120Vrms is connected to 220Vrms), a significant amount of power is consumed in the LED driving device, and thus, a large amount of heat may be generated in the LED driving unit to damage a component or a circuit. However, in the case of the present embodiment, since a driving current is cut off or reduced according to voltages of the output terminals of the respective LED groups, damage to the LED driving device or a fire due to a large amount of heat can be prevented.

In the present embodiment, a disconnection or a short circuit in an LED group or a current path can be easily determined from voltages of the respective input terminals T1, T2, . . . , Tn of the driving control unit 20". For example, when there is a disconnection in a single LED group, a difference between voltages between the adjacent input terminals T1, T2, . . . , Tn of the driving control unit 20" is significant, relative to a normal range, and when a short-circuit occurs, a difference between voltages may appear small, on the contrary. Thus, in the present embodiment, a disconnection or a short-circuit state of a circuit or a component is recognized as being able to prevent the LED driving device from operating in an abnormal state, thereby enhancing safety of a lighting device.

Figure 11:
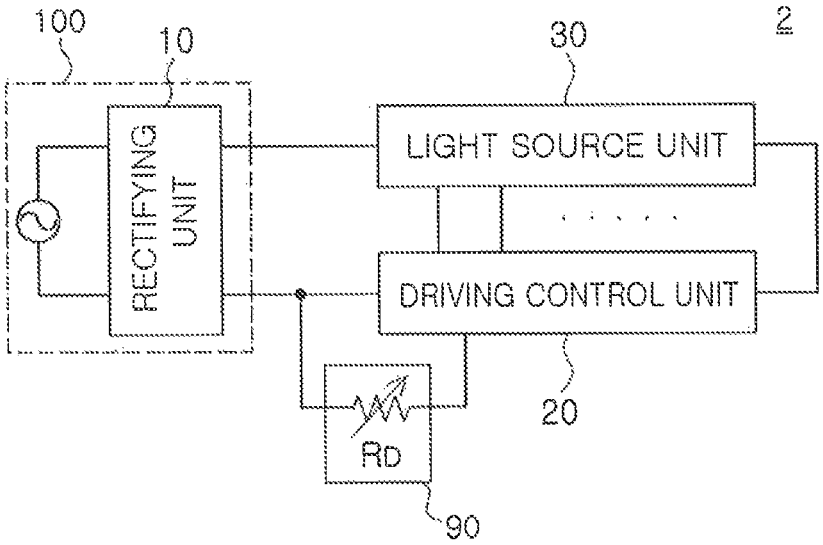
FIG. 11 is a view schematically illustrating a modification of the LED driving device according to an embodiment of the present invention.

FIG. 11 is a view schematically illustrating a modification of the LED driving device 1 according to an embodiment of the present invention. Specifically, FIG. 11 illustrates a configuration in which a variable resistor RD is added as a dimming signal generator 90 in order to input a dimming signal to the LED driving device 1 illustrated in FIG. 3. According to the present embodiment, since a variable resistor is added between a ground terminal of the power source unit 100 and the driving control unit 20, brightness of the light source unit 30 may be adjusted. In detail, brightness of the light source unit 30 may be adjusted by increasing or decreasing a current flowing in the light source unit 30 according to a magnitude of the variable resistor. Unlike this, in a case in which light having constant brightness is intended to be generated, a fixed resistance value may be used. In this case, the driving control unit 20 may apply a predetermined voltage to the variable resistor to receive a change in a current, as a dimming signal, or may apply a predetermined current to receive a change in a voltage, as a dimming signal.

Also, as a different method or changing a magnitude of a current flowing in the light source unit, a magnitude of a driving current flowing to each input terminal of the driving control unit may be changed upon receiving a dimming signal for adjusting brightness of the lighting device from the outside. According to the dimming signal input from the outside, driving currents flowing in all the input terminals of the driving control unit 20 may be changed in the same ratio, and also, magnitudes of currents flowing in the entirety or a portion of input terminals may also be changed in the same ratio. In this case, upon receiving the dimming signal input from the outside, the dimming signal generator 90 may output a different type of dimming signal to the driving control unit. The variable resistor is a dimming signal generator having a very simple form which receives a resistance value changed according to a physical operation of a user, as an external dimming signal, and outputs a dimming signal in the form of a voltage or a current to the driving control unit.

Figure 12:
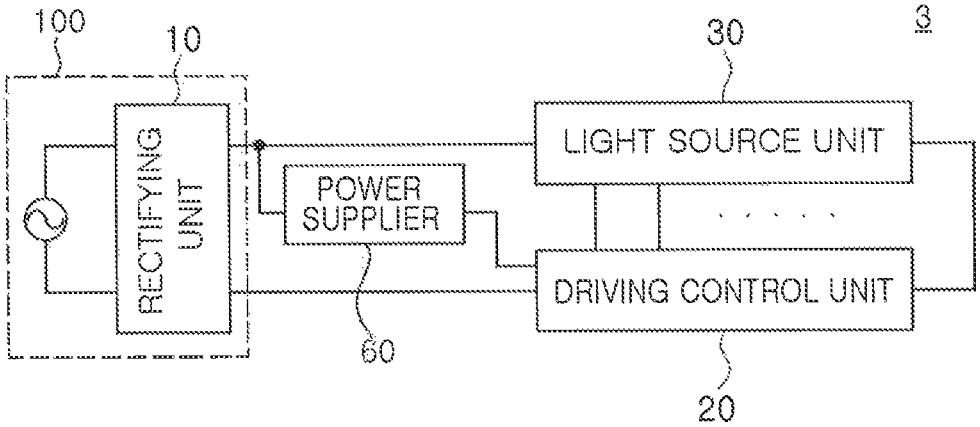
FIG. 12 is a view schematically illustrating another modification of the LED driving device according to an embodiment of the present invention.

FIG. 12 is a view schematically illustrating another modification of the LED driving device 1 according to an embodiment of the present invention. Specifically, FIG. 12 illustrates a configuration in which a power supplier 60 is added to the LED driving device 1 illustrated in FIG. 3. According to the present embodiment, a source voltage required for the driving control unit 20 is not received from the outside of the lighting device, or the driving control unit 20 does not generate a source voltage. Namely, the power supplier 60 receives DC power supplied from the power source unit 100 and generates a source voltage for driving control unit 20. The power supplier 60 may be implemented on the same chip in which the driving control unit 20 is installed, or may be implemented by using a separate component. The power supplier 60 may be implemented to supply source power required for the driving control unit 20 continuously even when a voltage of AC power input from the outside is 0.

Figure 13A:
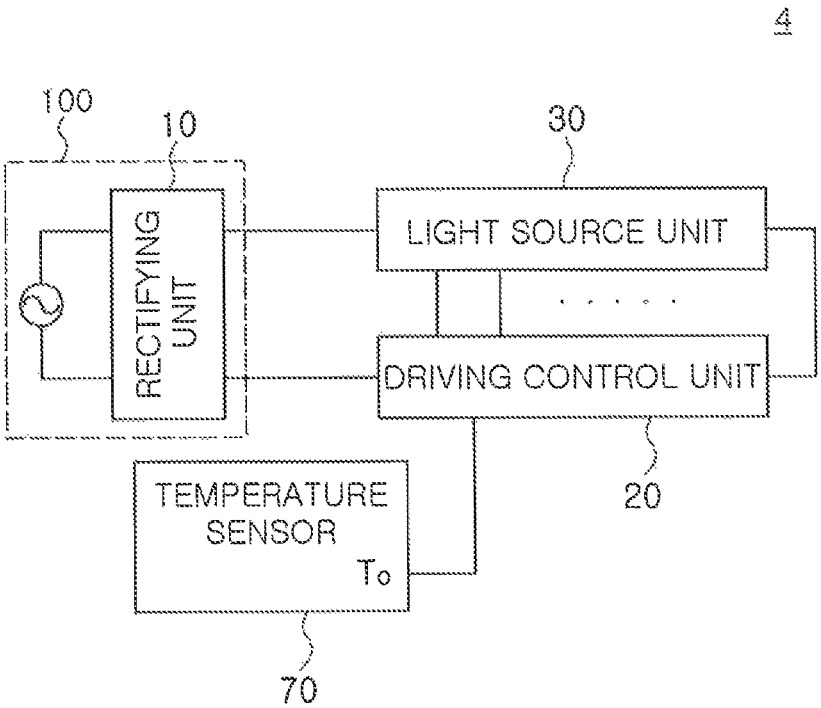
FIG. 13 is a view schematically illustrating another modification of the LED driving device according to an embodiment of the present invention.
Figure 13B:
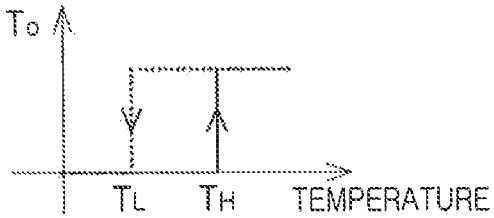

FIG. 13 is a view schematically illustrating another modification of the LED driving device 1 according to an embodiment of the present invention. Specifically, FIG. 13 illustrates a configuration in which a temperature sensor 70 is added to the LED driving device 1 illustrated in FIG. 3. Referring to FIGS. 13(*a*) and 13(*b*), the temperature sensor 70 senses a temperature of the light source unit 30 and transmits a temperature sensing signal To to the driving control unit 20 so that when a temperature of the light source unit 30 is equal to or higher than a predetermined level TH, an operation of the light source unit 30 is temporarily stopped, and when a temperature of the light source unit 30 is lowered to be equal to or lower than a predetermined level TL, the light source unit 30 resumes operation again, thus controlling an operation of the light source unit 30 according to the sensed temperature. In this case, in the temperature sensor 70, preferably, the temperature TH by which a temperature rise is recognized may be set to be higher than the temperature TL by which a temperature drop is recognized. Thus, as illustrated in FIG. 14B, the temperature sensing signals To when the temperature T rises or drops may have different hysteresis curves.

Meanwhile, the driving control unit may temporarily stop the operation of the light source unit according to a signal input from the temperature sensor, or may reduce a driving current continuously or by step according to a temperature. In this case, the temperature sensing signal To output from the temperature sensor may be different from that illustrated in FIG. 13B. In the present embodiment, the temperature sensor 70 may be implemented in the same chip in which the driving control unit 20 is implemented or may be implemented as a separate component.

Figure 14:
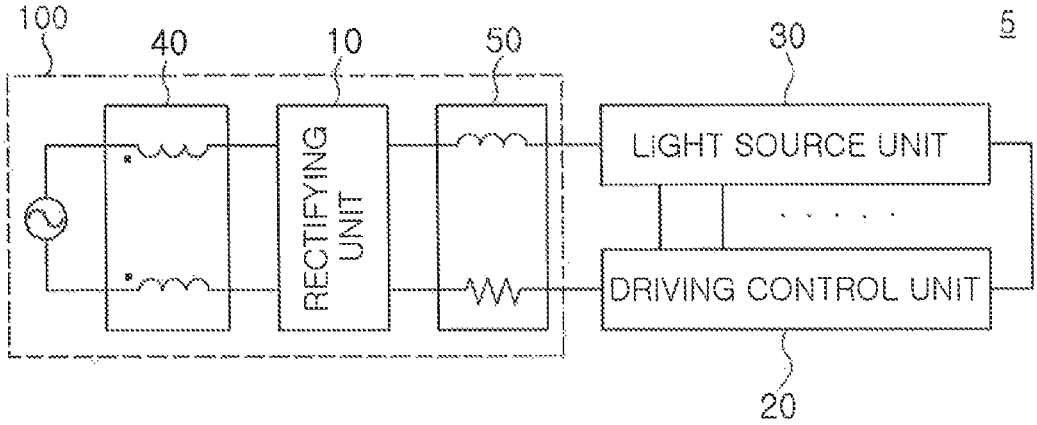
FIG. 14 is a view schematically illustrating another modification of the LED driving device according to an embodiment of the present invention.

FIG. 14 is a view schematically illustrating another modification of the LED driving device 1 according to an embodiment of the present invention. According to the present embodiment, the LED driving device may further include a common mode filter 40 and a line filter 50 added to the LED driving device 1 illustrated in FIG. 3. The common mode filter 40 is a noise filter for preventing common mode noise from being transferred to the AC power source, which does not substantially affect a differential component of an input/output signal.

Meanwhile, the line filter 50 refers to a filter cancelling noise of a differential component included in an electric line, which generally includes a coil and a condenser. The line filter 50 attenuates a high frequency component included in a voltage and a current between an input AC power source and the light source unit 30. As illustrated in FIG. 14, the line filter 50 may include an inductor and a resistor, and the resistor may be a thermistor such as a negative temperature coefficient (NTC), a critical temperature resistor (CTR), positive temperature coefficient (PTC), or the like. The resistor and the inductor constituting the line filter 50 may be disposed in one of two input lines or in both input lines. Alternatively, the resistor and the inductor may be disposed together in the same input line or may be separately disposed. Also, in the present embodiment, the common mode filter 40 and the line filter 50 are illustrated to be sequentially disposed between the external AC power source and the light source unit 30, but the present invention is not limited thereto and order thereof between the external AC power source and the light source unit 30 is not limited.

Although not shown in detail, in the LED driving device 1 according to the present embodiment, AC power may be received through a transformer, rather than being received directly from the outside, and in order to protect components constituting the LED driving device from ESD, surges, or the like, the power source 100 may further include a varistor, a transient voltage suppressor, or the like. Besides, in order to prevent an overcurrent from flowing to the AC power due to a short-circuit occurring in a conducting wire or a component in which a current flows. The LED driving device may further include a fuse.

Figure 15:
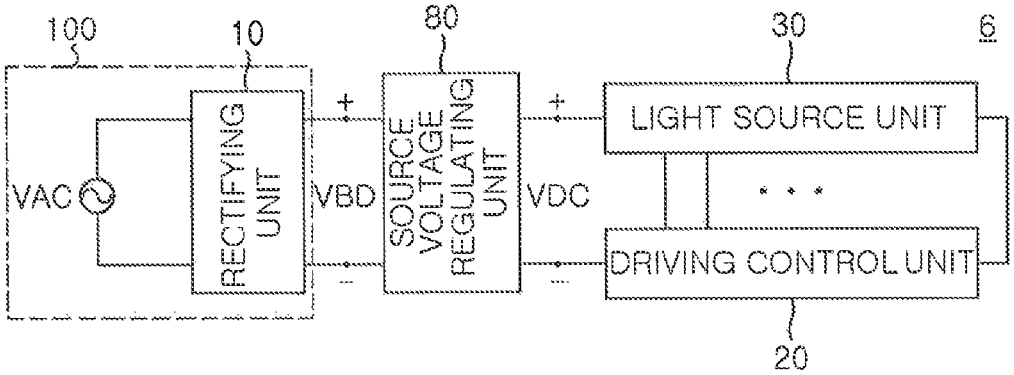
FIG. 15 is a view schematically illustrating another modification of the LED driving device according to an embodiment of the present invention.

FIG. 15 is a view schematically illustrating another modification of the LED driving device according to an embodiment of the present invention. In detail, the LED driving device according to the present embodiment may include a source voltage regulating unit 80 added to the LED driving device 1 illustrated in FIG. 3. The source voltage regulating unit 80 serves to regulate a DC source voltage output from the rectifying unit 10. As illustrated in FIG. 15, the source voltage regulating unit 80 may be connected between the rectifying unit 10 and the light source unit 30 to regulate a magnitude and a swing (or a range of fluctuation) of the DC source voltage input to the light source unit 30. In case of DC power generated by a rectifying element such as a full-wave rectifier it has very large voltage swing, and since a rectifying unit does not have a means for limiting an input current, a waveform of current input from an external AC power source is relied upon the characteristics of a load that receives a current from the rectifying element.

In the present embodiment, since the source voltage regulating unit 80 is added between the rectifying unit 10 and the light source unit 30 to regulate a magnitude and a swing of a source voltage input from the rectifying unit 10, a swing of the DC source voltage input to the light source unit may be reduced. As the source voltage regulating unit 80, for example, a passive or active power factor corrector (PFC) may be applied, but the present invention is not limited thereto. A PFC improves a power factor by making a waveform of a current input from the external AC power source approximate to a waveform of a voltage. An active PFC, which has a small volume and high power efficiency, is commonly used.

In the case of the active PFC, it can control an output voltage VDC, while maintaining a waveform of an input external AC current approximate to a waveform of an AC voltage. Namely, in order to increase a power factor, the PFC delivers a large amount of current to a load when the output voltage VBD of the rectifying element is high, and delivers a small amount of current when the output voltage VBD is low. Thus, when a resistive load exists in an output terminal of the PFC, the output voltage VDC from the PFC is increased or decreased according to the output voltage VBD from the rectifying element, and thus, the output voltage from the PFC has a swing within a predetermined range. In general, a swing of the output voltage VDC in the active or passive PFC may be reduced by increasing capacitance of a capacitor connected to an output terminal of the PFC. Here, structures and operations of the PFC vary, so a detailed description thereof will be omitted.

Figure 16:
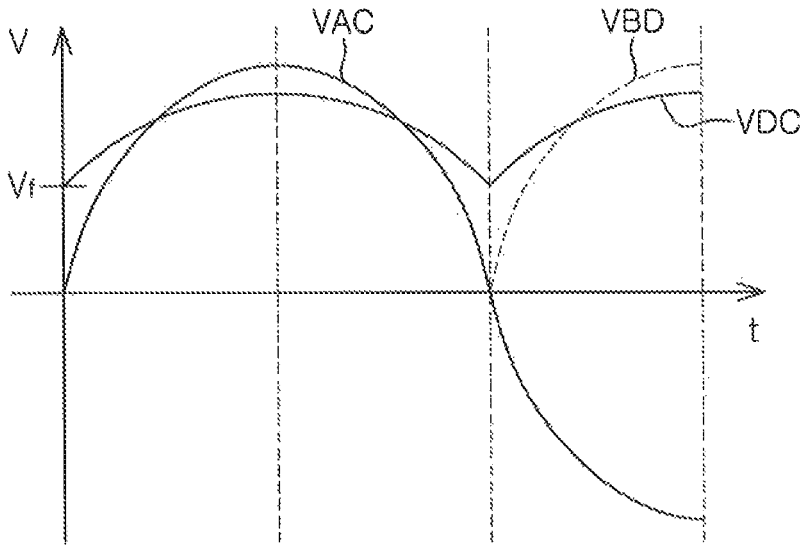
FIG. 16 is a view schematically illustrating input and output voltage waveforms of a rectifying unit and an output voltage waveform of a source voltage regulating unit in the LED driving device according to the embodiment illustrated in FIG. 15.

FIG. 16 is a view schematically illustrating input and output voltage waveforms of a rectifying unit and an output voltage waveform of a source voltage regulating unit in the LED driving device according to the embodiment illustrated in FIG. 15. Referring to FIG. 16, the voltage VAC of AC power input from the outside has a form of sine wave and a very large voltage swing, and the DC source voltage VBD obtained by full-wave rectifying the external AC source voltage VAC through the rectifying unit 10 also has a large voltage swing. However, as illustrated in FIG. 16, when the source voltage regulating unit 80 such as a PFC circuit is applied to an output terminal of the rectifying unit 10, a swing of the DC source voltage VDB input to the light source unit 30 may be significantly reduced, and by maintaining the source voltage input to the light source unit 30 at a level equal to or higher than a predetermined value, at least a portion (e.g., G1 and G2) of the LED groups G1, G2, . . . , Gn positioned to be adjacent to the output terminal of the source voltage regulating unit 80 may be constantly driven. In FIG. 29, it is illustrated that a peak voltage of the source voltage regulating unit 80 is lower than the external AC source voltage VAC or the output voltage VBD of the rectifying element, but the present invention is not limited thereto and the source voltage regulating unit 80 may output a peak voltage higher than the output voltage VBD of the rectifying element.

If a capacitor having high capacitance is used in the source voltage regulating unit 80 in order to reduce a swing of the DC source voltage input to the light source unit 30, the large volume of the capacitor having high capacitance may increase an overall volume of the driving device and costs thereof. However, the present embodiment is appropriate for a case in which the DC source voltage VDC input to the light source unit 30 is significantly fluctuated, and thus, a capacitor having large capacitance is not required to stabilize the output voltage VDC from the source voltage regulating unit 80.

Meanwhile, the source voltage regulating unit 80 may detect the output voltage VDC to increase or decrease a current input to the light source unit 30, and may maintain the DC source voltage VDC input to the light source unit 30 at a level equal to or higher than a predetermined value to allow a portion of the LED groups adjacent to the source voltage regulating unit 80 to be constantly driven.

In the present embodiment, as the DC source voltage output from the rectifying unit 10 and the source voltage regulating unit 80 is less fluctuated, the amount of LED groups required for maintaining high efficiency of the LED driving device may be reduced. Namely, when a DC source voltage input to the light source unit 30 is maintained at a level equal to or higher than a predetermined voltage Vf, all LED groups driven at a level equal to or higher than the predetermined voltage Vf may be grouped and driven. For example, when the predetermined voltage Vf is higher than a voltage able to drive the second LED group G2 and lower than a voltage able to drive the third LED group G3, the first and second LED groups G1 and G2 may operate as a single group. As the amount of driven LED groups is smaller, the structure of the driving control unit 20 is simplified, and components and wirings required for driving LEDs can be reduced.

Meanwhile, when a PFC is applied to the source voltage regulating unit 80, the driving control unit 20 does not need to consider a power factor and harmonic distortion of an AC current. Thus, a current input to the light source unit 30 and does not need to be provided to be approximate to a rectified sine wave. Here, although the driving control unit 20 provides control to make a current flow through as many LED groups as possible operable according to fluctuations in the DC source voltage output from the source voltage regulating unit 80, a waveform of a driven current is not limited.

Figure 17A:
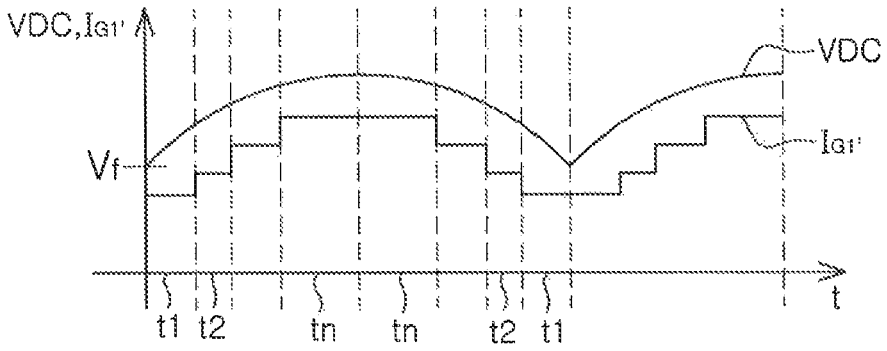
FIG. 17 is a view schematically illustrating current waveforms applicable to the LED driving device illustrated in FIG. 15.
Figure 17B:
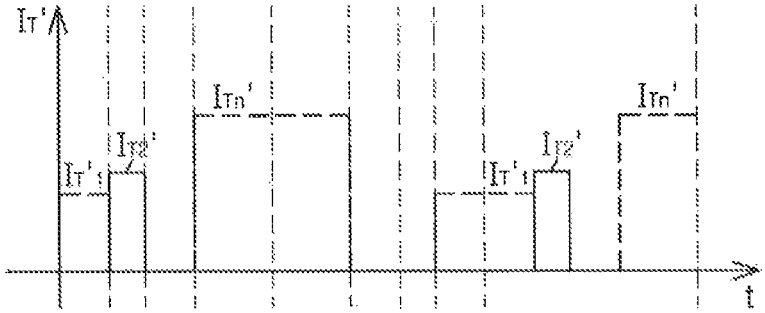

FIG. 17 is a view schematically illustrating waveforms of currents applicable to the LED driving device 6 illustrated in FIG. 15. In detail, FIG. 17A is a view illustrating waveforms of the DC source voltage VDC input to the light source unit 30 through the source voltage regulating unit 80 and a current $I_{G1}$' flowing in the first LED group G1', and FIG. 17B is a view schematically illustrating waveforms of first to nth input currents $I_{T1}$', $I_{T2}$', . . . , $I_{Tn}$' input to the driving control unit 20. FIG. 15 does not specifically illustrates respective input terminals of the first to nth LED groups G1', G2', . . . , Gn' and the driving control unit 20, but it may be understood that the other configurations excluding the source voltage regulating unit 80 are similar to those of FIG. 3.

Referring to FIG. 17, the DC source voltage VDC input to the light source unit 30 through the source voltage regulating unit 80 is maintained at a value equal to or higher than the predetermined voltage Vf, and accordingly, the first LED group G1' may be driven to have the current waveform illustrated in FIG. 17A. In the present embodiment, the first LED group G1' may be understood as being different from the first LED group G1 illustrated in FIGS. 3 and 4. In detail, it may refer to a group grouping the LED groups (e.g., G1 and G2 in FIG. 3) that may be driven at a level equal to or lower than the predetermined voltage Vf.

In the present embodiment, unlike the embodiment illustrated in FIG. 4, a non-driving section t0 in which the input DC source voltage VDC is so low that any LED group that cannot be driven does not exist, and at least one LED group G1' may be driven in every driving section. In the case of the present embodiment, a source voltage input to the light source unit 30 is maintained at a level equal to or higher than a predetermined level, whereby blinking of the LED lighting device can be effectively restrained.

% Flicker (or a modulation index), one of indices indicating blinking of the lighting device, is a value obtained by dividing a difference between a maximum value and a minimum value of optical power emitted during one period in the lighting device by an average thereof. Recently, demand for lowering % Flicker of lighting devices to below 50% has been increased.

Figure 17C:
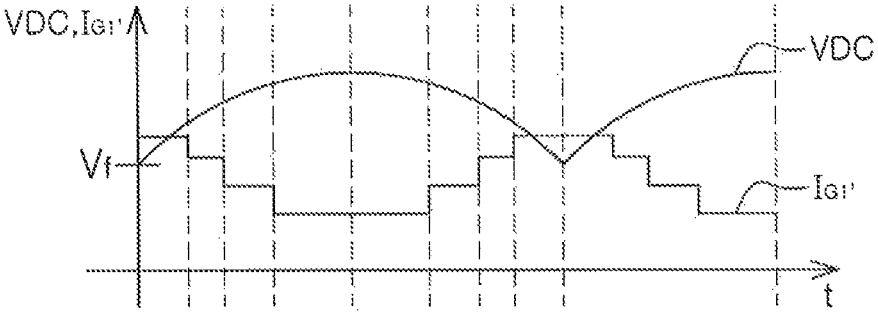

FIG. 17C illustrates different types of DC source voltage VDC input to the light source unit 30 and current flowing in the first LED group G1' according to an embodiment of the present invention. In order to further restrain blinking of a lighting device, a current flowing through the light source unit 30 is driven such that it is in inverse proportion to a magnitude of the DC source voltage VDC applied to the light source unit 30. In the present embodiment, the current flowing through the light source unit 30 may be provided to be in inverse proportion to the magnitude of the DC source voltage VDC in every driving section, and unlike this, the current may also be provided to be in inverse proportion to the magnitude of the DC source voltage VDC only in a portion of the driving sections. Here, when the magnitude of the driving current is in inverse proportion to the DC source voltage, it means that a smaller amount of current flows through the light source unit 30 in a driving section in which the DC source voltage is higher, and it is not limited to the case in which the product of the DC source voltage and current is constant.

In the present embodiment, since the DC source voltage VDC input to the light source unit 30 is in proportion to the magnitudes of the DC source voltage VBD converted by the rectifying unit 10 and the AC source voltage VAC input from the outside as illustrated in FIG. 16, it may also be expressed, in the LED driving method, such that the magnitude of the current flowing through the light source unit is provided to be in inverse proportion to the magnitude of the DC source voltage VBD converted by the rectifying unit 10 or the magnitude of the external AC source voltage VAC.

In the case in which the current flowing in the light source unit 30 is driven such that a magnitude thereof is in inverse proportion to the magnitude of the DC source voltage VDC, although the magnitude of the DC source voltage VDC input to the light source unit 30 is slightly changed according to fluctuations in the AC source voltage input from the outside, power consumption in the light source unit 30 is substantially uniformly maintained and optical power is also substantially uniformly maintained. The LED driving method as described above can be utilized to restrain a temperature change of the light source according to fluctuations in the external AC source voltage VAC.

Besides, in an embodiment of the present invention, a plurality of amounts of components may be disposed in a single lighting device so as to be used. Here, components, other than the light source unit 30 and the driving control unit 20, may be shared.

Figure 18:
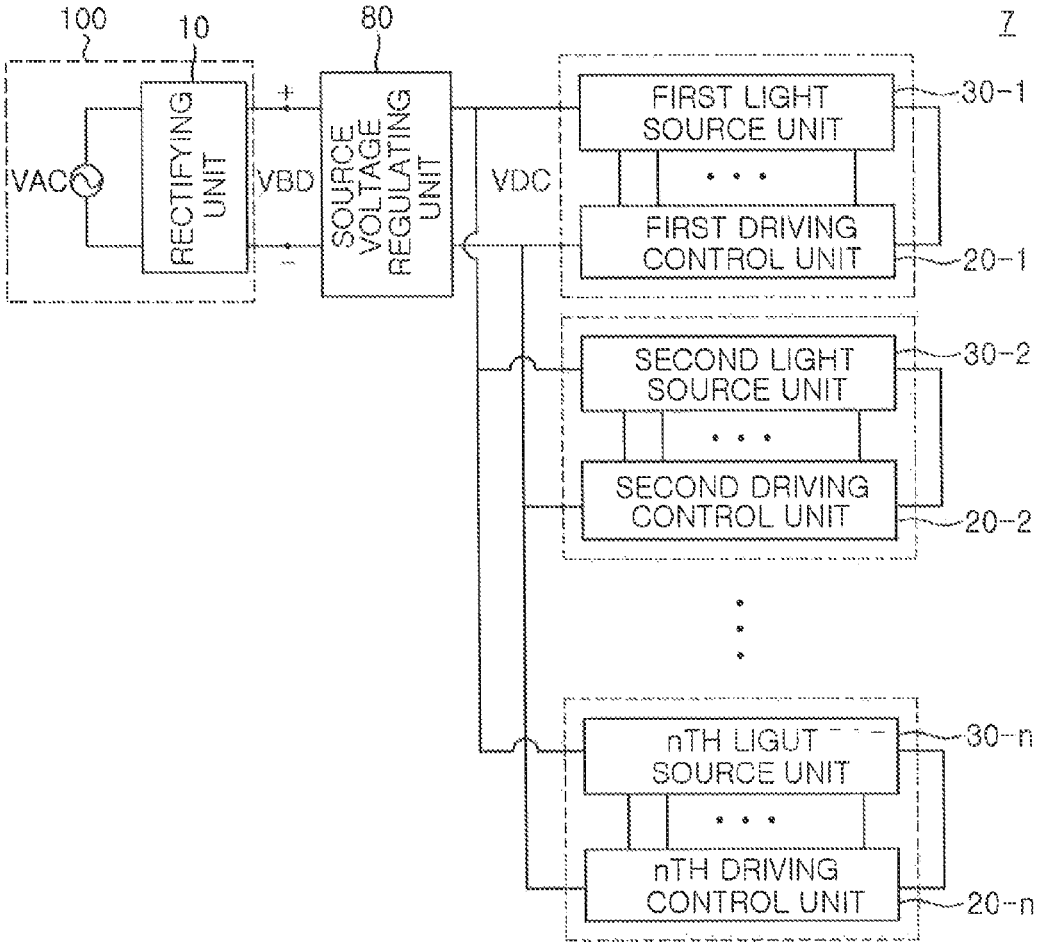
FIG. 18 is a view schematically illustrating an LED driving device according to another embodiment of the present invention.

FIG. 18 is a view schematically illustrating an LED driving device according to another embodiment of the present invention. Referring to FIG. 18, the LED driving device according to the present embodiment may include first to nth light source units 30-1, 30-2, . . . , **30-*n* connected to an output terminal of the source voltage regulating unit 80 and first to nth driving control units 20-1, 20-2, . . . , 20-*n* for driving the first to nth light source units 30-1, 30-2, . . . , 30-*n*. When the LED driving device includes the source voltage regulating unit 80 that receives the DC source output from the rectifying unit 10, regulates a voltage range, and outputs a corresponding voltage, the configuration of the driving control unit are simplified. Thus, it can be effectively applied to the case including a plurality of light source units and a plurality of driving control units as illustrated in FIG. 18**.

The present invention may be variously modified by applying a plurality of light source units 30-1, 30-2, . . . , **30-*n* and a plurality of driving control units 20-1, 20-2, . . . , 20-*n* to a single lighting device. As illustrated in FIG. 18, when the plurality of driving control units drive the light source units, separately, although the input terminals having the same degree of different driving control units are crossed, they can be operable. In implementing a lighting device, crossing of the input terminals having the same degree may facilitate wiring. Thus, when the embodiment illustrated in FIG. 18 is obtained by crossing the input terminals having the same degree, it should be regarded as being the same as the embodiment of FIG. 18**.

Although not specifically shown, in a modification including a plurality of light source units and a plurality of driving control units, a single light source unit may be driven by a plurality of driving control units. Here, input terminals of respective driving control units may be connected by sharing LED groups having the same degree constituting the light source unit. In a case in which a magnitude of a current that can be driven by a single driving control unit has already been determined, a higher current may be driven by using a plurality of driving control units. Here, forms of currents driven by the respective driving control units may be different. Waveforms of the currents driven by the plurality of driving control units may be equal to the sum of the currents driven by the respective driving control units in respective driving sections.

Also, in a modification in which a plurality of driving control units share a single light source unit, a portion of input terminals of a portion of driving control units may not be connected to an output terminal of the light source unit.

In another modification of the LED driving device illustrated in FIG. 18, a plurality of light source units may be configured to share a portion of LED groups. Here, sharing may refer to connecting input terminals and output terminals of LED groups having the same degree constituting different light source units such that a portion or the entirety of the plurality of LED groups connected in parallel are left. Also, it may also include a case in which output terminals of a plurality of LED groups having the same degree are connected. In this case, output terminals of the shared LED groups may be connected to a plurality of driving control units so as to be driven. In the case of this embodiment, the amount of components constituting the light source units may be reduced by sharing a portion of LED groups, and although a disconnection occurs in a portion of LED groups, different shared LED groups can be operated, increasing durability of the lighting device.

As another method of increasing durability of the lighting device, a new current path may be added to the light source unit. Two output terminals having different degrees may be connected by an LED group having the same current-voltage relationship as that of an LED group existing between the two output terminals. In this case, a new current path may be generated, and the new current path may be secured as a substitute path along which a current may flow when a disconnection occurs in an existing current path in a parallel connection relationship.

In this manner, in the lighting device employing a plurality of light source units and the plurality of driving control units driving the plurality of light source units, even in the case that the light source units are variously modified such that a portion of output terminals having the same degree are connected to allow a portion of LED groups to be shared, LED groups having the same degree are connected in parallel, the amount of LED groups in a parallel connection relationship is reduced, or a new LED group is added between output terminals of light source units having different degrees, and the like, if there is no change in driving sections and the respective driving control units are able to drive currents having the same magnitude by the same input terminals in the respective driving sections, the light source units are regarded as being the same. Namely, in view point of the present invention, although light source units are changed, if it does not affect electrical characteristics of the light source units, the light source units are regarded as having the same configuration.

Figure 19:
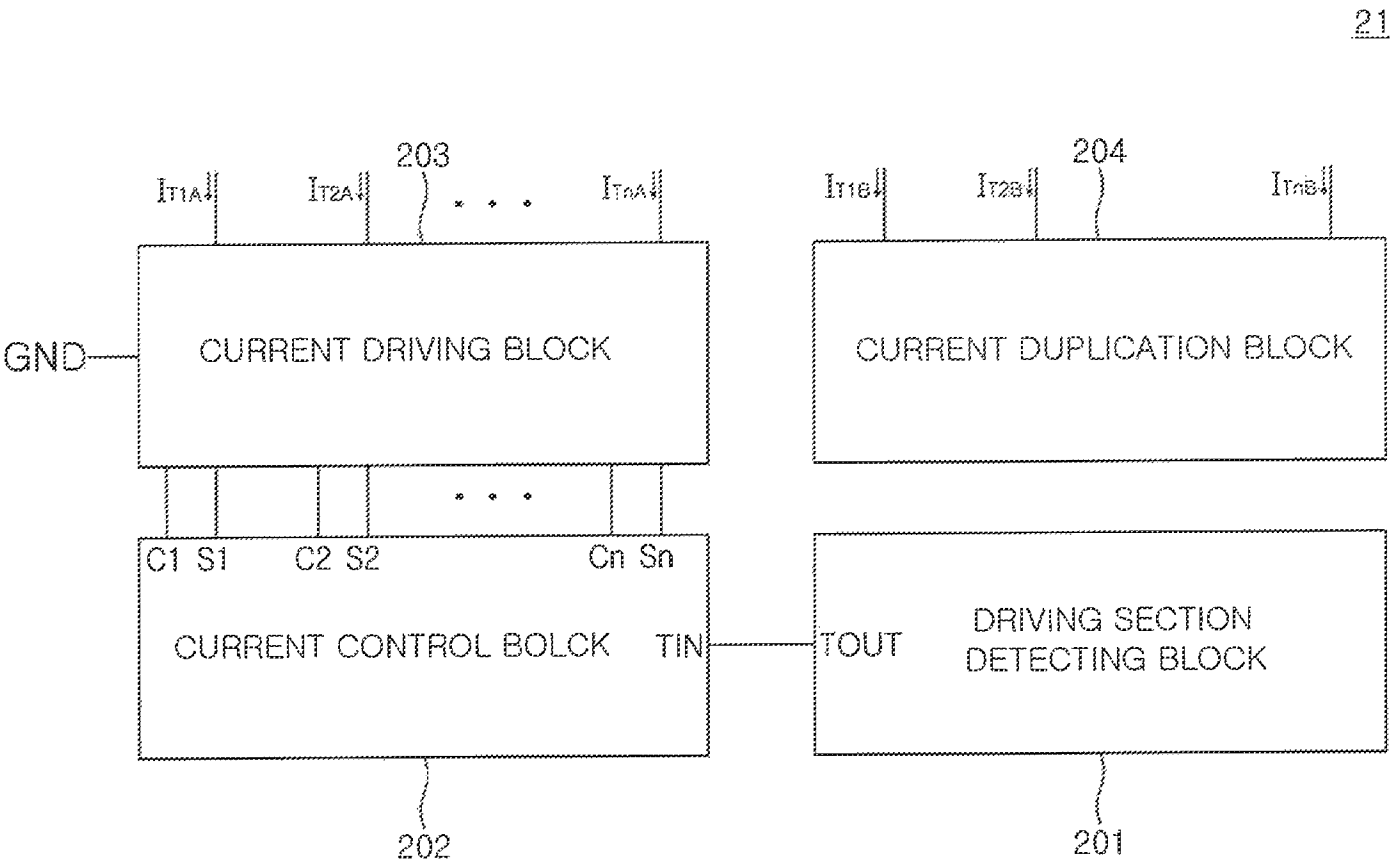
FIG. 19 is a block diagram schematically illustrating another modification of the driving control unit applicable to the LED driving device illustrated in FIG. 18.

FIG. 19 is a block diagram schematically illustrating a modified configuration of a driving control unit applicable to the LED driving device 7 according to another embodiment of the present invention. A driving control unit 21 according to the present embodiment may include a driving section detecting block 201, a current control block 202, a current driving block 203, and a current duplication block 204. The driving control unit may drive first to nth duplication currents $I_{T1B}, I_{T2B}, \ldots, I_{TnB}$ having a magnitude the same as that of first to nth input currents $I_{T1A}, I_{T2A}, \ldots, I_{TnA}$ input to the current driving block 203, through the current duplication block 204. In this case, the current duplication block 204 may drive a separate light source unit, while sharing control signals C1, C2, . . . , Cn output from the current control block 202. Namely, as illustrated in FIG. 18, in a case in which a lighting device includes a plurality of light source units, the driving control unit may further include a plurality of current duplication blocks 204 for driving a current having a magnitude the same as that of the current driving block 203 of the driving control unit, whereby a plurality of light source units can be further driven by the single driving control unit 20, and in this case, all of the light source units 30-1, 30-2, . . . , **30-*n* may be configured to have the same electrical characteristics. In the present embodiment, the current duplication block 204 may be implemented to have a configuration the same as that of the current driving block 203**, but the present inventive concept is not limited thereto.

Figure 20:
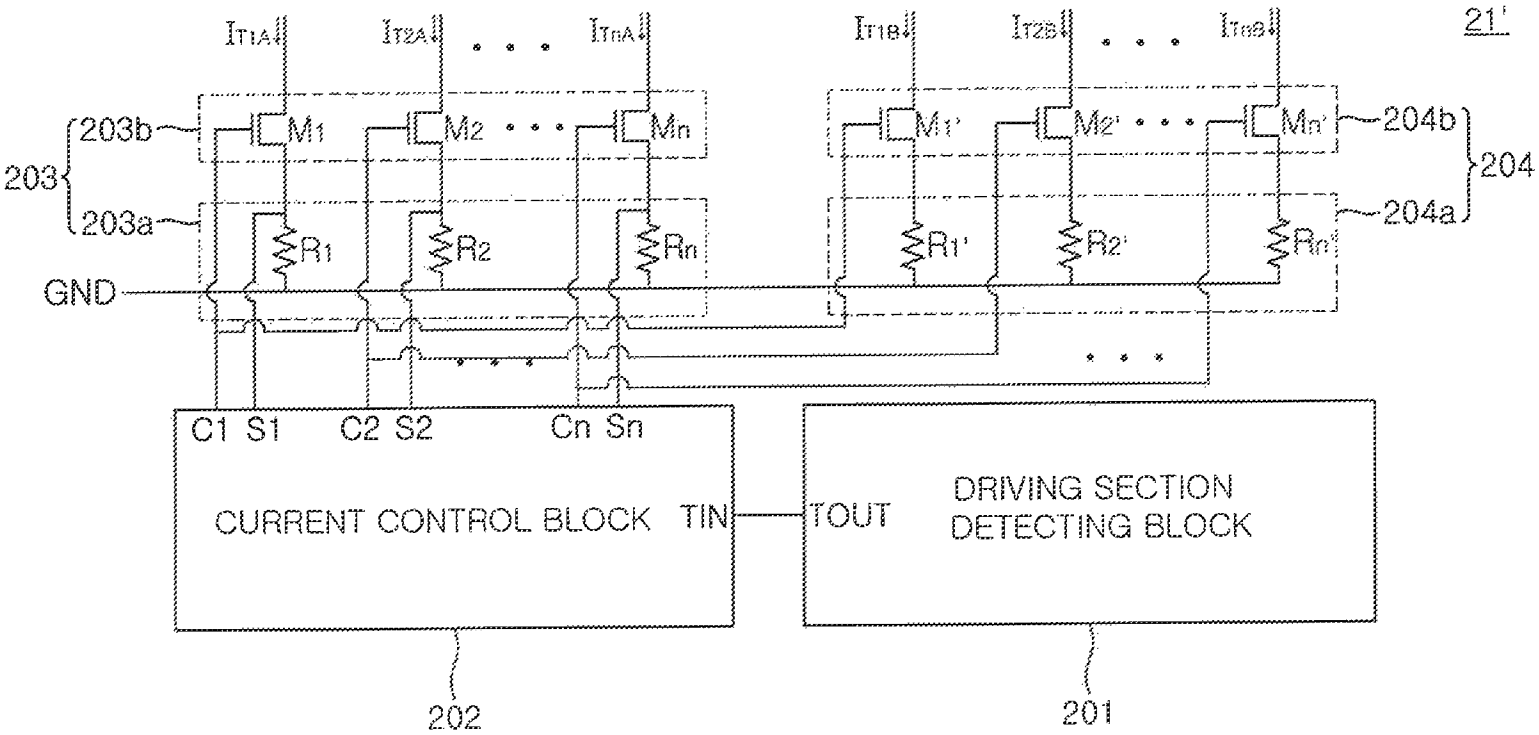
FIG. 20 is a view schematically illustrating an embodiment of the driving control unit illustrated in FIG. 19.

FIG. 20 is a view schematically illustrating a configuration of the current duplication block included in the driving control unit illustrated in FIG. 19. A driving control unit 21' according to the present embodiment may include a current duplication block 204 configured to have a configuration the same as that of the current driving block 203. The current driving block 203 and the current duplication block 204 are connected to respective input terminals, and may include current control units **203*b* and 204*b* for controlling each current input to the input terminals and current sensing units 203*a* and 204*a*** sensing a magnitude of a current input to each of the input terminals thereof, respectively.

The current sensing units **203*a* and 204*a* included in the current driving block 203 and the current duplication block 204 may sense magnitudes of first to nth input currents $I_{T1A}$, $I_{T2A}, \ldots, I_{TnA}$ and first to nth duplication currents $I_{T1B}$, $I_{T2B}, \ldots, I_{TnB}$ through voltages across the first to nth current sensing resistors R1, R2, . . . , Rn and R1', R2', . . . , Rn', respectively. By grounding one end of each of the resistors R1, R2, . . . , Rn and R1', R2', . . . , Rn' applied to the current sensing units 203*a* and 204*a*, voltages in the other ends thereof may be output as current sensing signals, but the present inventive concept is not limited thereto. Also, the current control units 203*b* and 204*b* may be implemented as MOSFETs M1, M2, . . . , Mn and M1', M2', . . . , Mn' to regulate a magnitude of a current input according to a control signal input from the current control block 202, but the present inventive concept is not limited thereto and the current control units 203***b* and 204*b* may be implemented as including BJT, IGBT, JFET, DMOSFET, or general current control elements including the same.

The current duplication block 204 illustrated in FIG. 20 has a configuration the same as that of the current driving block 203, and since the current duplication block 204 receives the same control signal from the current control block 202, it may drive input currents (e.g., $I_{T2A}$ and $I_{T2B}$ in the second driving section) having the same magnitude through input terminals having the same degree in the same driving section. In FIGS. 19 and 20, the driving control units 21 and 21' including a single current duplication block are illustrated, but a driving control unit including a plurality of current duplication blocks may be implemented to further drive the plurality of light source units 30-1, 30-2, . . . , 30-*n*. The current duplication block 204 may be implemented to have a configuration similar to that of the current driving block 203 as illustrated in FIG. 20, or may be implemented according to any other various methods.

As described above, in the LED driving device employing a plurality of light source units and a single driving control unit including a plurality of current driving blocks or a plurality of current duplication blocks, although the light sources are variously modified, if they have the same electrical characteristics, the light source units are regarded as having the same configuration in view point of the present invention.

The present invention is not limited to the foregoing embodiments and may be defined by the appended claims. Thus, it will be apparent to those skilled in the art that modifications and variations can be made without departing from the spirit and scope of the invention as defined by the appended claims, and may belong to the scope of the present invention.

The invention claimed is:

1. An LED driving device comprising:

a light source unit including first to nth LED groups by DC power and mutually sequentially connected in series; and a driving control unit including first to nth input terminals sequentially connected to output terminals of the first to nth LED groups, respectively, and sensing currents flowing to a ground through the first to nth input terminals to generate information regarding a driving section to control magnitudes and a path of the currents flowing in the light source unit, wherein the driving control unit includes a driving section detecting block which comprises a finite state machine (FSM) having different states according to the driving sections.

2. The LED driving device of claim 1, wherein the driving control unit controls a path such that a current is input to one of the first to nth input terminals according to the information regarding the driving section.

3. The LED driving device of claim 2, wherein the driving control unit controls a path such that a current is input through an input terminal having a highest degree that can be driven in each driving section.

4. The LED driving device of claim 2, wherein the driving control unit controls a path such that currents are input to the first to nth input terminals of the driving control unit in the first to nth driving sections of the DC source voltage, respectively.

5. The LED driving device of claim 2, wherein the driving control unit drives a larger current as degrees of the first to nth input terminals are higher.

6. The LED driving device of claim 2, wherein the driving section detecting block senses currents flowing to a ground through the first to nth input terminals from the first to nth LED groups, respectively, to generate the information regarding the driving sections, and wherein the driving control unit further comprises:

a current control block receiving information regarding the driving sections from the driving section detecting block and generating a control signal for controlling magnitudes and a path of the currents input to the driving control unit; and a current driving Hock adjusting and sensing magnitudes of first to nth input currents input to the first to nth input terminals according to the control signal generated by the current control block, and generating first to nth current sensing signals corresponding to the magnitudes of the first to nth input currents.

7. The LED driving device of claim 6, wherein the current driving block comprises:

first to nth current control units connected to the first to nth input terminals, respectively, and controlling first to nth input currents into to the first to nth input terminals of the driving control unit according to the control signal generated by the current control block, respectively; and a current sensing unit sensing respective currents flowing to a ground through the first to nth current control units.

8. The LED driving device of claim 7, wherein at least a portion of the first to nth current control units further comprises a current buffer.

9. The LED driving device of claim 6, wherein the light source unit is provided in plural, and the driving control unit further comprises a current duplication block driving the other remaining light source units not driven by the current driving block, among the plurality of light sources, upon receiving a control signal the same as that of the current driving block from the current control block.

10. The LED driving device of claim 1, wherein the FSM changes a state thereof according to magnitudes or variations in currents input to the first to nth input terminals, as input signals.

11. The LED driving device of claim 1, wherein the FSM changes a state thereof according to a dock signal, according to the magnitudes of the currents input from output terminals of the first to nth LED groups to the first to nth input terminals thereof, as input signals.

12. The LED driving device of claim 1, wherein the driving section detecting block generates information regarding the driving sections according to the magnitudes of the current input to the first to nth input terminals, as input signals.

13. The LED driving device of claim 1, wherein the information regarding the driving sections are transferred as a plurality of signals generated by determining whether the DC source voltage is within a plurality of driving ranges configured to include one or more continued driving sections.

14. The LED driving device of claim 1, wherein the driving control unit receives voltage from the first to nth output terminals and changes magnitude of current inputted to the first to nth input terminals, and wherein the driving control unit drives a current input to an input terminal of at least one of the first to nth input terminals such that the current has a plurality of levels.

15. The LED driving device of claim 1, wherein the driving control unit further comprises a dimming signal generator changing magnitudes of first to nth input currents input to the first to nth input terminals upon receiving a dimming signal from the outside.

16. The LED driving device of claim 1, further comprising a power supply unit supplying DC power to the light source unit, wherein one end of the first LED group is connected to the power supply unit, and the other end thereof is sequentially connected to the second to nth LED groups in series.

17. The LED driving device of claim 16, wherein a plurality of light source units are connected to an output terminal of the power supply unit in parallel.

18. The LED driving device of claim 1, wherein the driving control unit drives a magnitude of a current flowing through the first LED group such that the magnitude is inverse proportional to a magnitude of the DC source voltage in at least a portion of driving sections.

19. An LED driving device comprising;

a light source unit including first to nth LED groups by DC power and mutually sequentially connected in series; and a driving control unit including first to nth input terminals sequentially connected to output terminals of the first to nth LED groups, respectively, and sensing currents flowing to a ground through the first to nth input terminals to generate information regarding a driving section to control magnitudes and a path of the currents flowing in the light source unit, wherein the driving control unit includes a driving section detecting block which generates the information regarding driving sections by determining whether test currents flow through the plurality of input terminals connected to the first to nth input terminals, respectively.

20. An LED driving device comprising:

a light source unit including first to nth LED groups by DC power and mutually sequentially connected in series; and a driving control unit including first to nth input terminals sequentially connected to output terminals of the first to nth LED groups, respectively, and sensing currents flowing to a ground through the first to nth input terminals to generate information regarding a driving section to control magnitudes and a path of the currents flowing in the light source unit, wherein the driving control unit drives a magnitude of a current flowing through the first LED group such that the magnitude is inverse proportional to a magnitude of the DC source voltage.

* * * * *